US007927192B2

(12) United States Patent
Annis

(10) Patent No.: US 7,927,192 B2
(45) Date of Patent: Apr. 19, 2011

(54) TOOL FOR WORKING ON A SURFACE

(75) Inventor: Kent V. Annis, Burnsville, MN (US)

(73) Assignee: Full Circle International, Inc, Burnsville, MN (US)

( * ) Notice: Subject to any disclaimer, the term of this patent is extended or adjusted under 35 U.S.C. 154(b) by 621 days.

(21) Appl. No.: 11/869,454

(22) Filed: Oct. 17, 2007

(65) Prior Publication Data

US 2009/0104864 A1 Apr. 23, 2009

(51) Int. Cl.
*B24D 15/00* (2006.01)

(52) U.S. Cl. ..... 451/456; 15/143.1; 451/524; 451/525

(58) Field of Classification Search ..... 451/354, 451/456, 523, 557, 524, 525; 15/143.1, 144.1, 15/144.2, 145, 228, 229.2, 229.6–229.9; 34/95.1, 95.2; 144/252.1
See application file for complete search history.

(56) References Cited

U.S. PATENT DOCUMENTS

| | | | | |
|---|---|---|---|---|
| 1,501,192 | A | | 7/1924 | Severns |
| 1,520,642 | A | | 12/1924 | Giroux |
| 2,112,593 | A | | 3/1938 | Campbell |
| 2,417,680 | A | | 3/1947 | Decker |
| 2,474,064 | A | | 6/1949 | Paul |
| 2,663,979 | A | | 12/1953 | Sierchio |
| 2,780,533 | A | | 2/1957 | Hurst |
| 3,089,294 | A | | 5/1963 | Cowley |
| 3,105,329 | A | | 10/1963 | Sgorbati, Sr. |
| 3,850,533 | A | * | 11/1974 | Thielen ..... 403/58 |
| 3,991,431 | A | * | 11/1976 | Thielen ..... 15/147.2 |
| 4,062,152 | A | | 12/1977 | Mehrer |
| 4,184,291 | A | | 1/1980 | Marton |
| 4,391,013 | A | | 7/1983 | Janssen |
| 4,399,170 | A | | 8/1983 | Janssen |
| 4,424,603 | A | | 1/1984 | Balint et al. |
| 4,617,767 | A | | 10/1986 | Ali |
| 4,625,462 | A | | 12/1986 | Fushiya et al. |
| 4,714,644 | A | | 12/1987 | Rich |
| 4,782,632 | A | | 11/1988 | Matechuk |
| 4,825,597 | A | | 5/1989 | Matechuk |
| 4,829,719 | A | | 5/1989 | Braselton |
| 4,848,037 | A | | 7/1989 | Happe |

(Continued)

FOREIGN PATENT DOCUMENTS

DE 3105426 A1 8/1982

(Continued)

OTHER PUBLICATIONS

Fibatape, "Vacuum Sanding Products", http://www.fibatape.com/product_gallery/vacuum_sanding.html.

(Continued)

*Primary Examiner* — Timothy V Eley
(74) *Attorney, Agent, or Firm* — Brooks, Cameron & Huebsch, PLLC

(57) ABSTRACT

Embodiments of the present disclosure provide working tools that provide suction to a working surface and/or dust removal from a working surface. One embodiment of a tool includes a tool support having an upper surface and a sidewall defining a cavity defined by the sidewall and the upper surface. The tool includes a base attached to the upper surface of the tool support and a vacuum attachment structure attached to the base. The attachment structure includes a connector member having an opening in a first end for releasable attachment to a vacuum source.

13 Claims, 13 Drawing Sheets

U.S. PATENT DOCUMENTS

| | | | | | |
|---|---|---|---|---|---|
| 4,885,876 | A | * | 12/1989 | Henke | 451/503 |
| 4,937,984 | A | * | 7/1990 | Taranto | 451/524 |
| 4,964,243 | A | * | 10/1990 | Reiter | 451/354 |
| 4,966,609 | A | | 10/1990 | Callinan et al. | |
| 5,007,206 | A | | 4/1991 | Paterson | |
| 5,016,402 | A | | 5/1991 | Reiter | |
| 5,056,268 | A | | 10/1991 | Wolff | |
| 5,103,599 | A | | 4/1992 | Carlson | |
| 5,168,672 | A | | 12/1992 | Gregoire, Sr. | |
| 5,193,313 | A | * | 3/1993 | Sanchez et al. | 451/344 |
| 5,201,785 | A | | 4/1993 | Nagano | |
| 5,239,783 | A | | 8/1993 | Matechuk | |
| 5,283,988 | A | | 2/1994 | Brown | |
| 5,309,681 | A | | 5/1994 | Cheney et al. | |
| 5,313,746 | A | | 5/1994 | Zarriello | |
| D353,313 | S | | 12/1994 | Stiles | |
| D354,666 | S | | 1/1995 | Kriebel | |
| 5,419,087 | A | | 5/1995 | Haddy | |
| 5,527,212 | A | | 6/1996 | Bowen et al. | |
| 5,545,080 | A | | 8/1996 | Clowers et al. | |
| 5,605,500 | A | | 2/1997 | Matechuk | |
| 5,607,345 | A | | 3/1997 | Barry et al. | |
| 5,624,305 | A | * | 4/1997 | Brown | 451/354 |
| 5,662,519 | A | | 9/1997 | Arnold | |
| 5,690,545 | A | | 11/1997 | Clowers et al. | |
| 5,791,977 | A | | 8/1998 | Clowers et al. | |
| 5,885,145 | A | | 3/1999 | O'Mara | |
| 5,895,316 | A | | 4/1999 | Williams | |
| 5,947,803 | A | | 9/1999 | Gruner | |
| 5,962,102 | A | | 10/1999 | Sheffield et al. | |
| 6,053,805 | A | | 4/2000 | Sanchez | |
| 6,059,850 | A | | 5/2000 | Lise et al. | |
| 6,095,911 | A | | 8/2000 | Edens | |
| 6,109,811 | A | | 8/2000 | Song | |
| 6,227,959 | B1 | | 5/2001 | Beaudry | |
| 6,267,658 | B1 | | 7/2001 | Ali et al. | |
| 6,325,708 | B1 | | 12/2001 | Miles | |
| 6,361,424 | B1 | | 3/2002 | Manor et al. | |
| 6,406,365 | B1 | | 6/2002 | Ueno | |
| 6,468,141 | B1 | | 10/2002 | Conboy et al. | |
| 6,500,057 | B1 | | 12/2002 | Medina | |
| 6,523,214 | B1 | | 2/2003 | Kaiser | |
| 6,524,175 | B2 | | 2/2003 | Beaudry et al. | |
| 6,634,937 | B1 | | 10/2003 | Edwards et al. | |
| 6,659,852 | B1 | | 12/2003 | Wettstein et al. | |
| D497,092 | S | | 10/2004 | McCarthy | |
| 6,991,529 | B2 | | 1/2006 | Annis et al. | |
| 7,033,259 | B1 | | 4/2006 | Seasholtz et al. | |
| 7,063,474 | B2 | | 6/2006 | DeFields et al. | |
| 7,249,996 | B1 | * | 7/2007 | Volyar | 451/354 |
| 2001/0000503 | A1 | * | 4/2001 | Beaudry et al. | 451/523 |
| 2004/0180616 | A1 | * | 9/2004 | Loveless | 451/354 |
| 2006/0073778 | A1 | * | 4/2006 | Phillips et al. | 451/354 |
| 2006/0199484 | A1 | | 9/2006 | Brown | |

FOREIGN PATENT DOCUMENTS

| | | | |
|---|---|---|---|
| GB | 846413 | | 12/1958 |
| GB | 1238006 | | 7/1971 |
| GB | 2298379 | A | 9/1996 |
| GB | 2299038 | | 9/1996 |

OTHER PUBLICATIONS

"Marshalltown DuraSoft Dustless Drywall Vacuum Sander" http://www.amazon.com/Marshalltown-DuraSoft-dustless-Drywall-Vacuum/dp/B000....

* cited by examiner

TOOL FOR WORKING ON A SURFACE

INTRODUCTION

Hand held tool devices have been utilized in many fields for working the surface of a material, such as sanding, polishing, and painting, among others. For example, when fabricating a structure, such as a wall or ceiling in a building, oftentimes it is necessary to utilize a sanding device to smooth the surface of the structure. In response to this need, in the field of sanding devices, for example, various devices have been proposed.

One device utilizes a sanding head having an elongate rectangular shape. Such heads are designed to accommodate a standard sized elongate sheet of sand paper, thereby making the supply of sanding paper readily accessible. However, when the device is manipulated, due to its narrow configuration, the device tends to flip onto its elongate sides and can damage the surface of a wall, for example, by gouging the surface with the corners or edges of the device, requiring filling or additional sanding to remove the damage.

Another device utilizes a motorized rotating head that rotates rapidly to reduce the number of passes the device must take over an area. These devices are larger and more cumbersome due to the mechanical motor assembly and have a circular, non-continuous "O" shaped working surface due to the need to have access to a bolt. The bolt is seated in the center of the "O" defined by the working surface. This device takes a greater level of skill to master and if used improperly, can damage the surface by dishing to create swirl marks in the surface.

Further, devices have been proposed to vacuum away dust from the working surface, however, in devices proposed, the air is circulated around the working material (e.g., sand paper) and, therefore, only vacuums the dust that is at the edges of the device. Such devices have also typically been heavy and, therefore, difficult to maintain in position on the working surface, such as a wall or ceiling, among other surfaces.

DETAILED DESCRIPTION

Embodiments of the present disclosure provide working tools that provide suction to a working surface and/or dust removal from a working surface. For example, one embodiment of a tool includes a tool support having an upper surface and a sidewall defining a cavity defined by the sidewall and the upper surface. The tool includes a base attached to the upper surface of the tool support and a vacuum attachment structure attached to the base. The attachment structure includes a connector member having an opening in a first end for releasable attachment to a vacuum source.

Some embodiments of a tool according to the present disclosure include a tool support having an upper surface and a sidewall that defines a cavity between the sidewall and the upper surface. Various embodiments include an attachment structure attached to the tool support. The attachment structure can include a connector member having an opening in a first end for releasable attachment to a handle and/or vacuum source, a socket member that receives a lower portion of the connector member and is connected to the connector member at a first pivoting point to provide for rotation of the connector member about a first axis, and a tilt plate that receives the socket member and is connected to the socket member and to the base at a second pivoting point to provide for rotation of the connector member about a second axis.

In various embodiments, a tool head can include a body separable into at least two parts. In such embodiments, the tool head can include a first tool support and a second tool support. In various embodiments, the first tool support can include a base coupled to a connector member for releasable attachment to a vacuum source. In some embodiments, the second tool support is releasably attached to a lower surface of the first tool support, and the second tool support has an upper surface and a side wall defining a cavity defined by the sidewall and the upper surface.

One or more embodiments of a tool for working on a surface include a first tool support including a hollow grasping handle having a first end and a second end. In some such embodiments, at least one of the first end and second end of the handle are in fluid communication with an aperture through the first tool support. The tool can include a vacuum attachment member coupled to the hollow grasping handle for releasable attachment to a vacuum source and a second tool support to which the first tool support is releasably attachable.

Figure 1A:
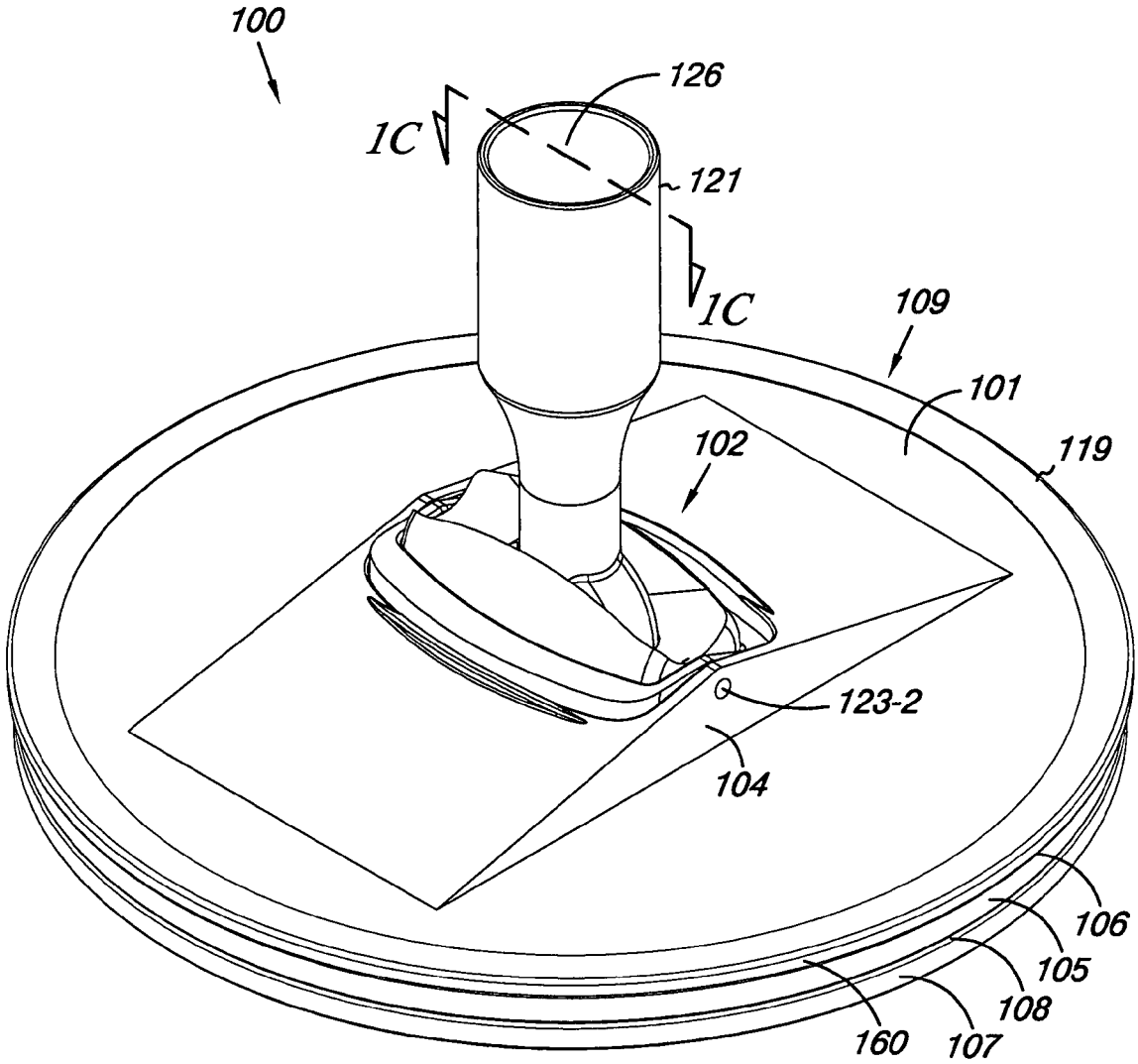
FIG. 1A illustrates a top perspective view of a tool for working on a surface according to an embodiment of the present disclosure.
Figure 1B:
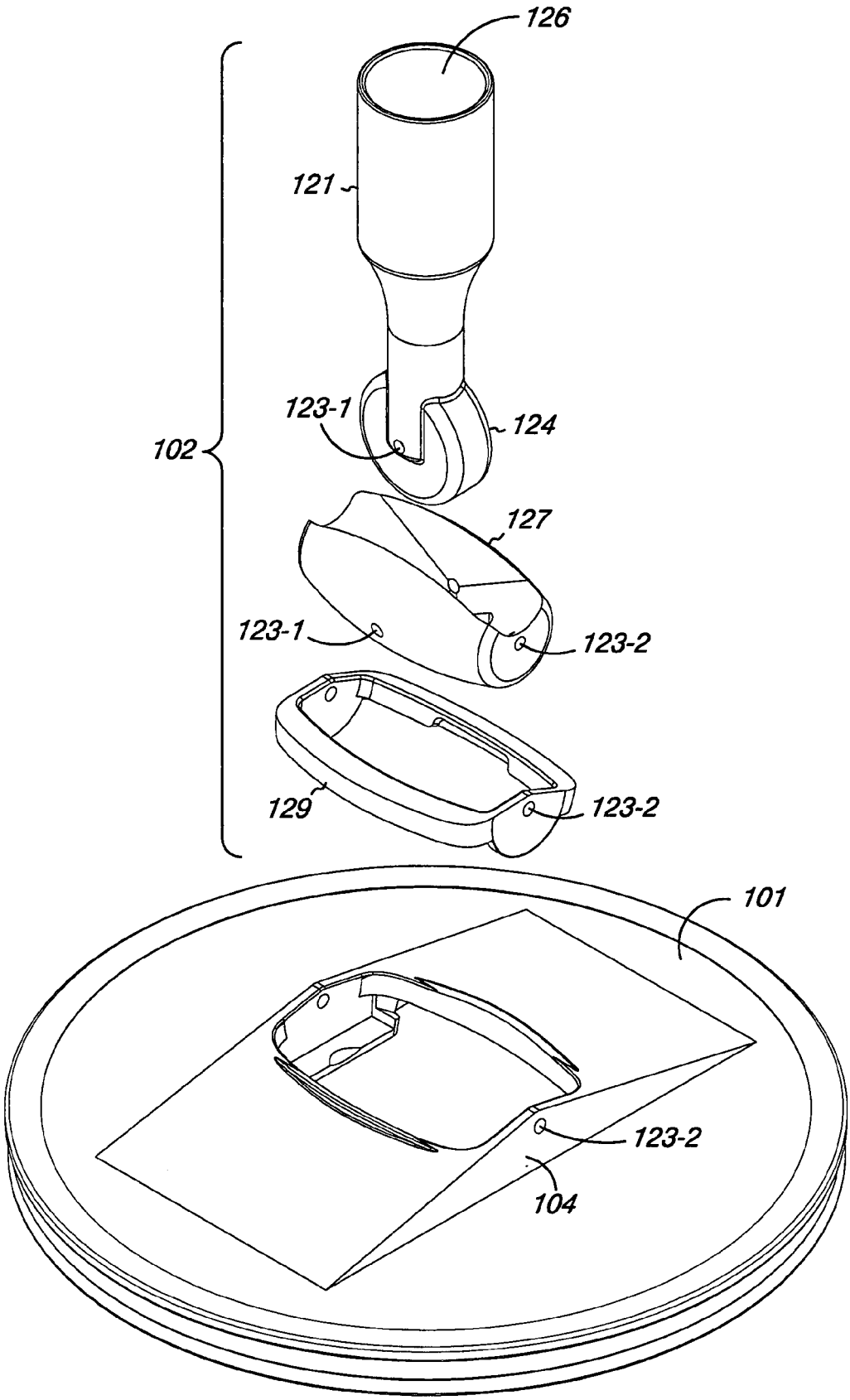
FIG. 1B illustrates an exploded view of the tool embodiment shown in FIG. 1A.
Figure 1C:
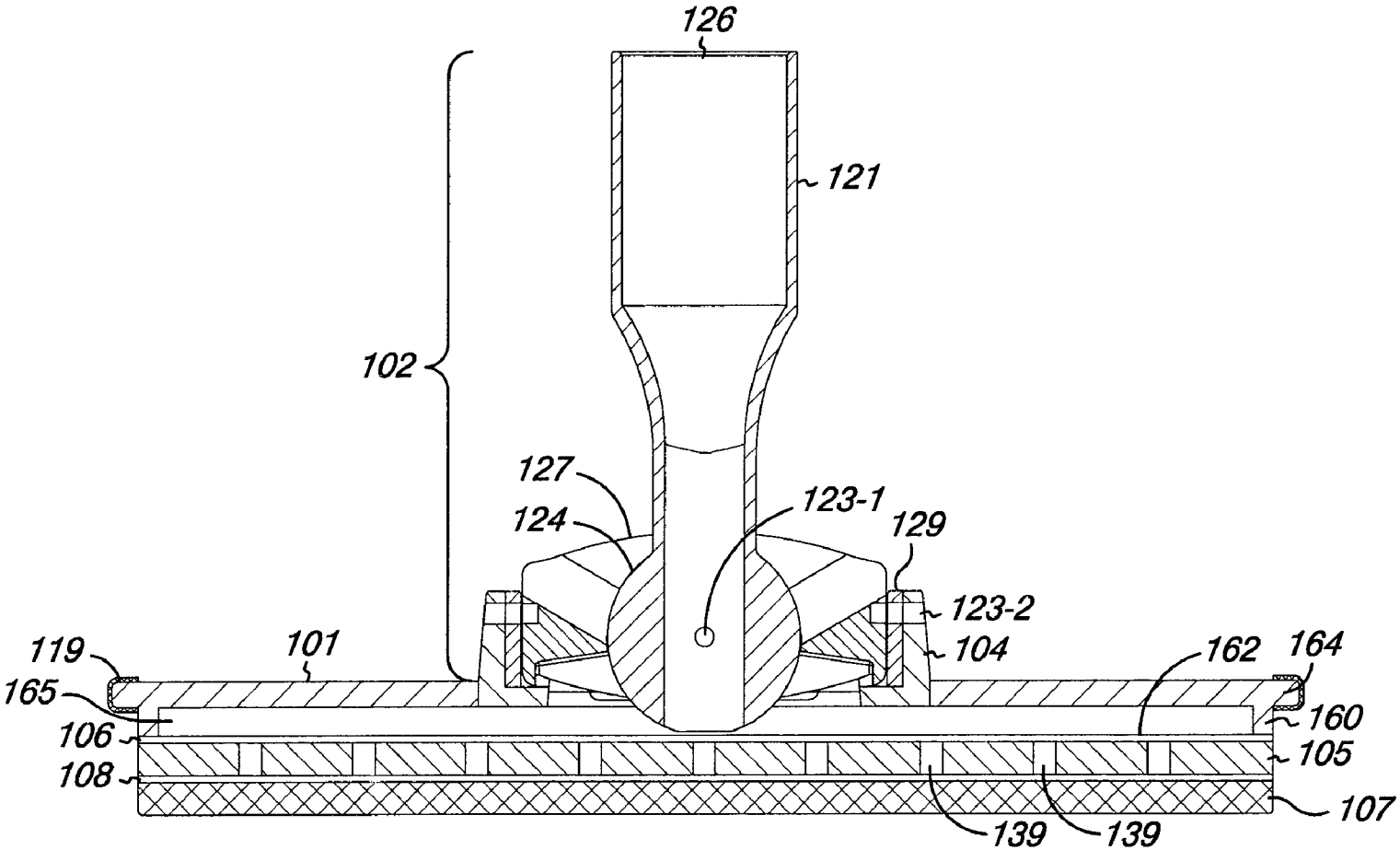
FIG. 1C illustrates a cross sectional view of the tool embodiment shown in FIG. 1A taken along line 1C-1C.
Figure 1D:
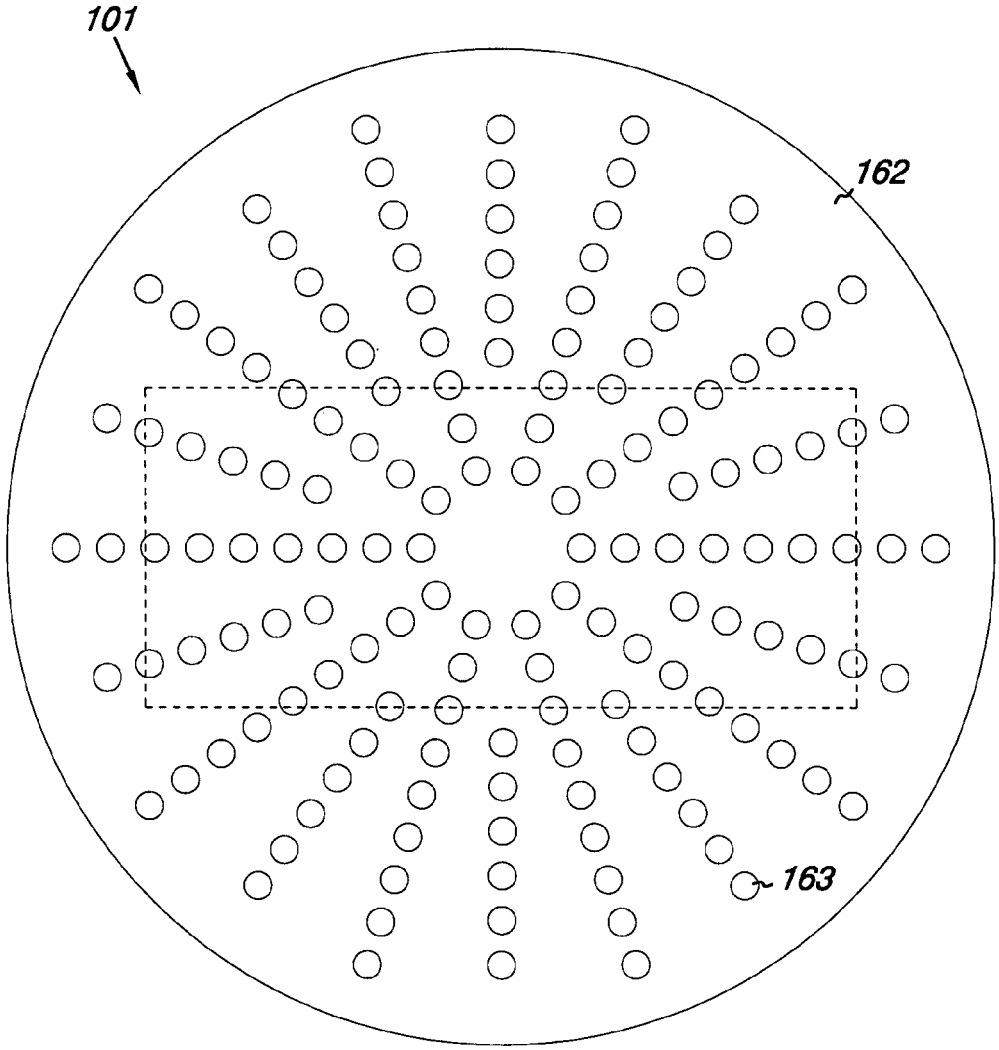
FIG. 1D illustrates a bottom view of a portion of the tool embodiment shown in FIG. 1A.
Figure 1E:
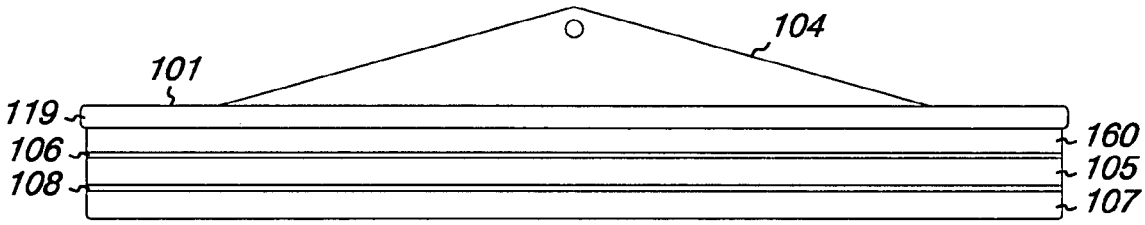
FIG. 1E illustrates a side view of a portion of the tool embodiment shown in FIG. 1A.

FIGS. 1A-1E illustrate a tool 100 for working on a surface according to an embodiment of the present disclosure. FIG. 1A illustrates a top perspective view of the tool 100, FIG. 1B illustrates an exploded view of the tool 100, FIG. 1C illustrates a cross sectional view of the tool 100, FIG. 1D illustrates a bottom view of a portion of the tool 100, and FIG. 1E illustrates a side view of a portion of the tool 100 shown in the embodiment of FIG. 1A.

In the embodiment illustrated in FIG. 1A, the tool 100 includes a tool support 101. A base 104 is attached to an upper surface of the support 101 and an attachment structure 102 is attached to the base 104.

In various embodiments, the attachment structure includes an opening (e.g., 126) for releasable attachment to a vacuum source (e.g., a shop vacuum or other vacuum source). As described herein, in various embodiments, a vacuum source can be connected to the attachment structure and operated to provide suction to a working surface, such as a wall, and/or to remove dust from a working surface via one or more apertures in the tool support (e.g., tool support 101). As one of ordinary skill in the art will appreciate, in various embodiments, the opening (e.g., 126) can be coupled to a vacuum source via pole or handle.

Figure 6A:
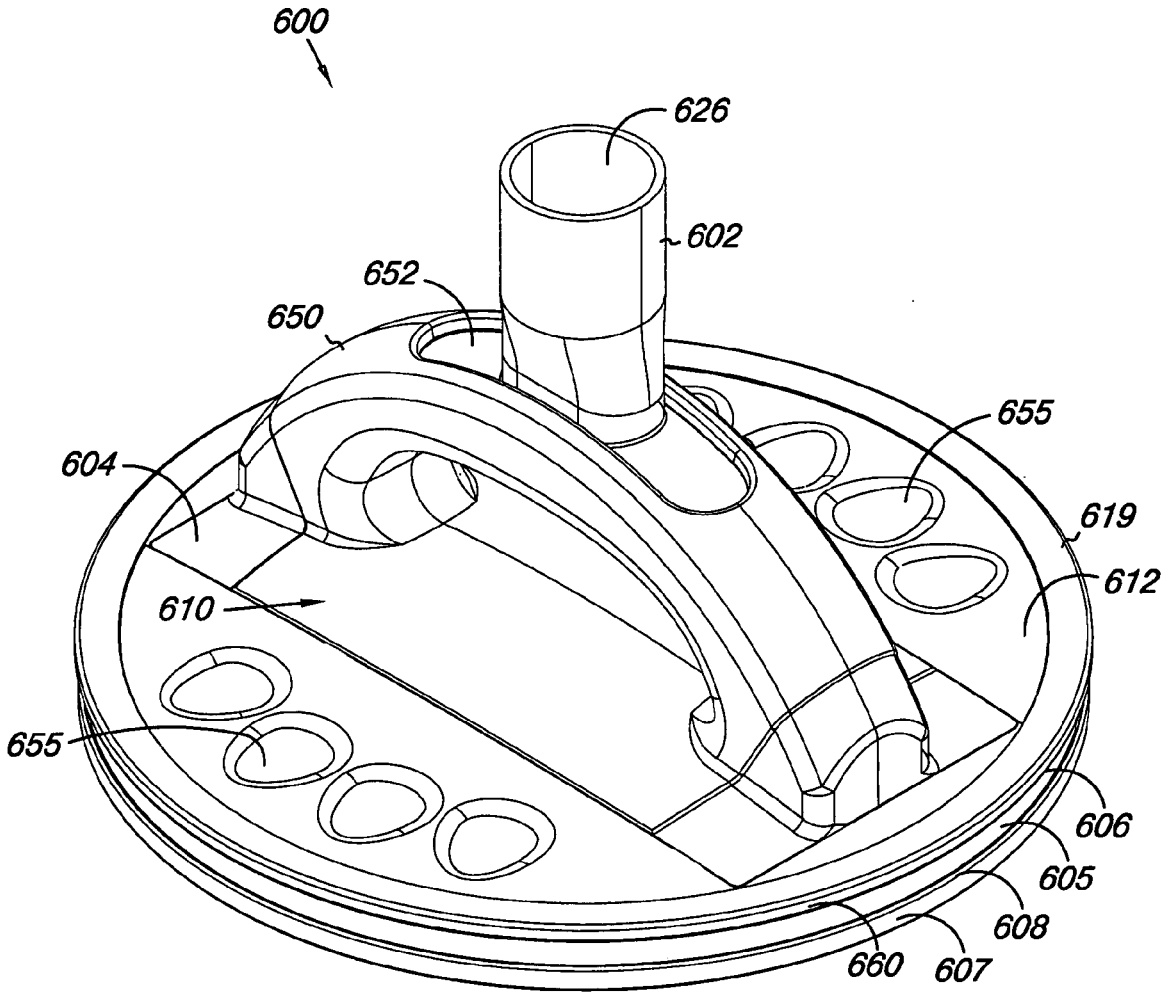
FIG. 6A illustrates a top perspective view of a tool head separable into a first tool support and a second tool support according to an embodiment of the present disclosure.
Figure 6B:
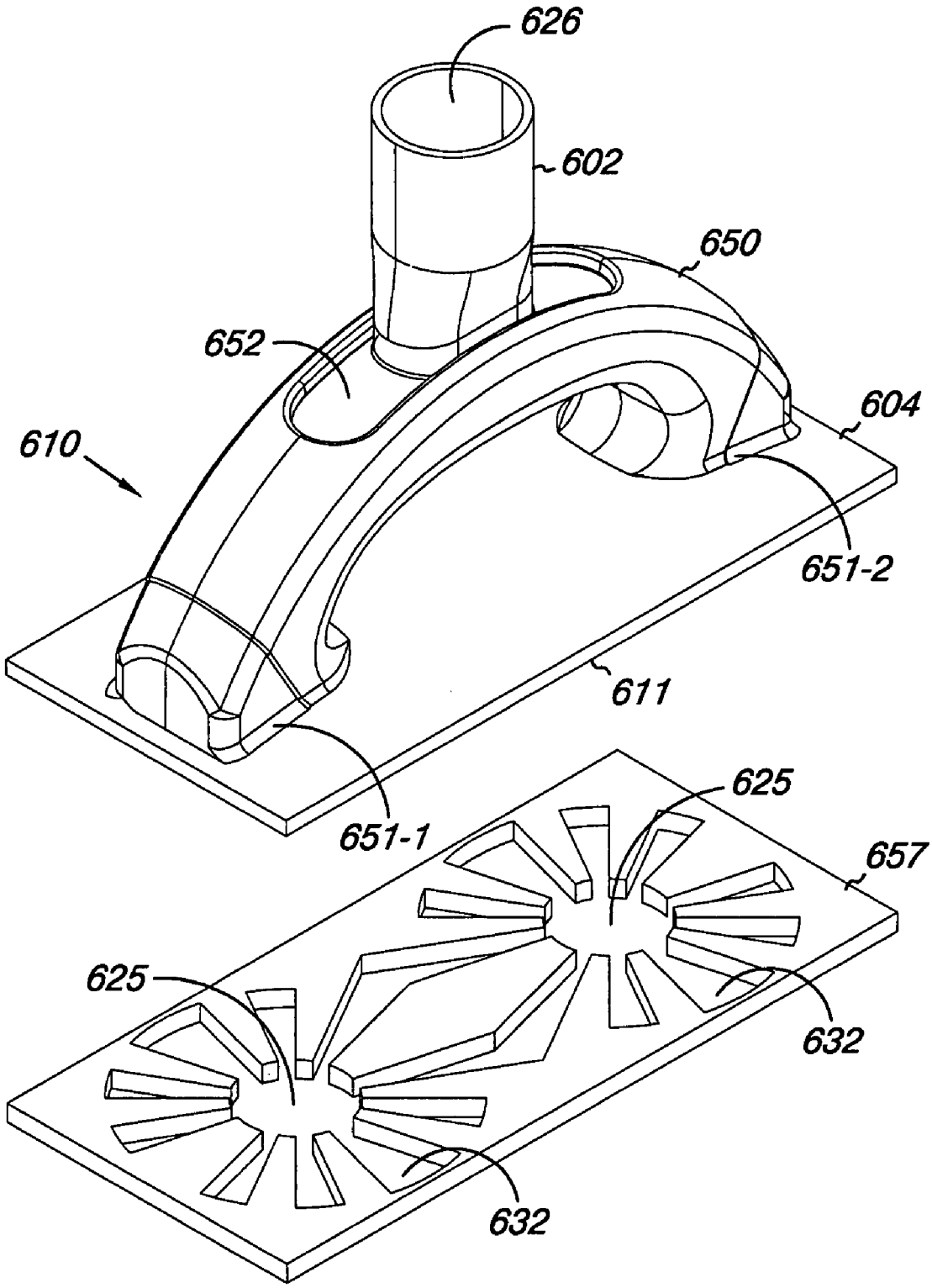
FIG. 6B illustrates a perspective view of the first tool support shown in FIG. 6A.

In some embodiments, and as described further in connection with FIGS. 6A and 6B, the attachment structure can be a hollow grasping handle. In the embodiment illustrated in FIGS. 1A-1E, the attachment structure 102 is a pivoting structure attached to a base portion 104 of the tool support 101. The tool support can be a rigid tool support made of various metals and/or rigid plastics, among various other rigid materials.

In various embodiments, and as shown in FIGS. 1B and 1C, the pivoting attachment structure 102 can include a connector member 121, a socket member 127 and a tilt plate 129. In various embodiments, such as that shown in FIG. 1C, for example, the connector member 121 can include an opening 126 in a first end for releasable attachment to a vacuum source.

In such embodiments, the connector member 121 has a hollow portion therethrough to provide a path for fluid to flow through the connector member 121. In some embodiments, the connector member does not have a fluid flow path and can be used for connection to a handle that is not equipped with a vacuum source.

As shown in FIGS. 1A-1C, the lower portion 124 of the connector member 121 passes through a slot in the socket member 127 and is rotatably attached thereto via pivoting point 123-1. That is, the socket member 127 receives a lower portion 124 of the connector member 121 and is connected to the connector member 121 at a first pivoting point 123-1 to provide for rotation of the connector member about a first axis (e.g., an axis through pivot point 123-1). In one or more embodiments, the tilt plate 129 receives the socket member 127 and is connected to the socket member 127 and to the base 104 at a second pivoting point 123-2 to provide for rotation of the connector member 121 about a second axis (e.g., an axis through pivot point 123-2).

The connector member 121 can be attached to the socket member 127 with a rivet or other attachment mechanism suitable for allowing rotational movement of the connector member 121 about the axis through pivoting point 123-1. The socket member 127 and tilt member 129 can be attached to the base with a rivet or other suitable attachment mechanism allowing rotational movement of the connector member about the second axis through pivoting point 123-2. In various embodiments, the first axis is transverse to the second axis (e.g., an axis through pivoting point 123-2 is transverse to an axis through pivoting point 123-1).

Tools having an attachment structure such as attachment structure 102 can provide various benefits. For instance, the axes of rotation associated with the attachment structure 102 can be located closer to the tool support (e.g., 101) than previous attachment structures, which can reduce and/or prevent flipping of the tool. Also, the attachment structure 102 can provide suitable suction to a working surface and/or dust removal from the working surface for various desired angles of the connector member 121 during use of the tool 100. For instance, the tilt plate 129 can maintain the opening in the lower portion 124 of the connector member 121 in fluid communication with the cavity 165 for many desired angles of the connector member 121.

Various embodiments of the present disclosure are not limited to the use of the two directional pivotable attachment structure shown. For example, a ball joint or other universal joint type structure can be utilized.

The connector member (e.g., 121) can be attached to a vacuum source (not shown) in any suitable manner. For example, the opening (e.g., 126) can be threaded and/or tapered in various embodiments for receiving an end of a hollow pole or hose (not shown) which can in turn be connected to a vacuum source (e.g., a portable type vacuum or other vacuum source).

In various embodiments, and as shown in FIG. 1C, the lower portion 124 of the connector member can be positioned such that an opening in a second end of the connector member is located below the upper surface of the tool support and provides fluid communication between the vacuum cavity (e.g., 165) and the opening (e.g., 126) at the first end of the connector member. In some such embodiments, placement of the lower portion 124 of the connector member 121 below the upper surface of the tool support 101 can facilitate increased suction of tool 100 to a working surface and/or can facilitate increased dust removal therefrom.

In one or more embodiments, the lower portion 124 of the connector member 121 can extend below a lower surface (e.g., 162) of the tool support 101. In various embodiments, one or more layers (e.g., a pad layer, an attachment layer, a working material, etc.) attached to a lower surface (e.g., 162) of the tool support can include a recessed portion (e.g., recessed portion 247 shown in FIG. 2B or recessed portion 347 shown in FIG. 3) to accommodate the lower portion of the connector member 121.

In various tool embodiments, the tool support can include various numbers of layers attached to a lower surface of the tool support. In the embodiment illustrated in FIGS. 1A-1E, the tool support 101 includes a pad 105 attached to the lower surface 162 of the support 101.

The pad can be a rigid (i.e., inflexible) or resilient material and, in some embodiments, the pad can be replaceably attached to the tool support. That is, in some embodiments, the pad layer can be attached to the tool support in a releasable manner such that the pad can be replaced (e.g., with a different pad or other layer).

In various embodiments, where the pad is a resilient material, it can be utilized, for example, to cushion the force of the support on the surface being worked on, among other benefits. In some embodiments where the pad is an inflexible material, it can be utilized, for example, to distribute force more directly to the surface being worked on, among other benefits.

The attachment of the various layers to the tool support and/or to each other can be accomplished in any manner. For instance, the pad can be attached to the tool support with an attachment layer. The attachment layer can include various fastening mechanisms such as hook and loop fasteners, glues, and/or epoxies, among other fastening mechanisms. In the embodiment illustrated in FIGS. 1A-1E, the pad 105 is attached to a lower surface 162 of the tool support 101 via an attachment layer 106. The attachment layer 106 can be, for example, hook and loop fasteners that can be utilized to releasably attach one or more layers of tool 100 (e.g., tool support 101 and pad 105) to each other.

In various embodiments, the lower surface (e.g., 162) of the tool support (e.g., 101) can include a number of apertures therein for facilitating dust removal from the working surface through the vacuum cavity (e.g., 165) and connector member (e.g., 121). One embodiment of the lower surface 162 is illustrated in FIG. 1D. FIG. 1D is a bottom view of the lower surface 162 of the tool support 101, with the dotted portion representing the base 104 attached to the upper surface as shown in FIGS. 1A and 1B.

In the embodiment illustrated in FIG. 1D, the lower surface 162 of the tool support includes a number of apertures 163. The apertures can be in any suitable pattern or orientation.

For example, the apertures 163 extend radially outward from the center of the tool support to the periphery of the tool support. Such a radiating embodiment may provide better flow for suction, in some embodiments.

Although the apertures 163 are shown as being circular apertures having the same size, embodiments are not so limited. For instance, in some embodiments, the apertures can have varying sizes. In some embodiments, the apertures in lower surface 162 can be elongate channels having various shapes.

In various embodiments, the pad (e.g., 105) can be fluid permeable (e.g., air permeable) to allow the passage of dust and/or other particulate therethrough. In various embodiments, one or more apertures can be provided in the pad.

In some embodiments, the apertures in the pad can be aligned (e.g., in fluid communication) with apertures and/or channels in the tool support (e.g., apertures 163 shown in FIG. 1D). The one or more apertures and/or channels that can be provided in the tool support and/or any of the various layers (e.g., pad 105) herein can be of any suitable shape. For example, in the embodiment shown in FIG. 1C, the pad 105 includes a number of apertures 139 therethrough.

In various embodiments, a working material can be positioned on the tool support itself and in some embodiments, the working material can be releasably attached to the tool support and/or one or more other layers attached thereto. Such embodiments allow for the working material to be removed and replaced and/or changed to a different kind of working material.

In some embodiments, and as shown in FIGS. 1A-1E, the pad can have a working material attached thereto (e.g., to a bottom surface and/or one or more side surfaces of the pad). In various embodiments, the working material can be releasably attached to the pad.

In such embodiments, the working material can then be replaced without changing the pad and the pad can be replaced without having to dispose of the working material. In the embodiment of FIGS. 1A-1E, the tool 100 includes a working material 107 replaceably attached to pad 105 via attachment layer 108 (e.g., hook and loop fasteners).

Working materials can be any type of material that can be utilized to perform work on a surface. Some examples of working materials include, but are not limited to abrasive materials such as sand paper, materials for the application of paint or stain, and materials for polishing, among others.

In some embodiments, the working material can include a rigid backing having a number of hard particles provided thereon. In embodiments in which the working material includes a rigid backing, the rigid backing can be formed of various metals such as stainless steel, among other rigid materials.

The hard particles on the rigid backing can be particles of various materials. In embodiments in which the working material includes a rigid backing having a number of hard particles provided thereon, the number of particles can be ultra hard particles. As used herein, ultra hard particles refers to particles of materials having a hardness of at least 7 on a Mohs hardness scale in which diamond has a hardness of 10. Examples of ultra hard materials include tungsten carbide, silicon carbide, boron carbide, aluminum oxide, and steel, among others.

In various embodiments, the rigid backing can reduce or prevent the ultra hard particles from damaging the rigid backing by penetrating the backing while the tool is applied to a working surface, as can occur with working materials having non-rigid backings (e.g., sandpaper or other abrasives having non-rigid backings). In such embodiments, the rigid backing can be replaceably attached to the tool support such as via releasable fastening structures including mechanical and/or chemical structures. Suitable mechanical structures include hook and loop attachments among others.

Suitable chemical structures include releasable glues, adhesives, epoxies, and the like. One suitable adhesive is a pressure sensitive adhesive (PSA).

In embodiments in which the working material includes a rigid backing, the particles can be provided thereon in various manners. For example, the particles can be brazed on the rigid backing, and/or can be adhered to the rigid backing via an epoxy and/or other adhesive suitable for permanently adhering the particles to the rigid backing.

In various embodiments, the working material can include a grit size of less than or equal to an ISO (international organization for standardization) 6344 standard size of P24. That is, in such embodiments the coarseness of the grit is P24 or coarser. In such embodiments, the coarseness and/or hardness of the working material can be beneficial in applications such as scoring EPS (Expanded Polystyrene) foam or removing some ceiling textures, among other applications.

In embodiments in which the working material includes a rigid backing, the rigid backing can have various shapes as described herein. For instance, in some embodiments, the rigid backing can have a periphery having at least five points equidistant from a center of the tool support. In some embodiments the shape of the rigid backing can be the same as the shape of the tool support and/or a pad attached thereto.

In embodiments in which the working material includes a rigid backing, the rigid backing can have a number of apertures therethrough. In embodiments in which the rigid backing has a number of apertures therethrough, the apertures can be shaped similar to the apertures shown in layers 205-1 and/or 205-2 shown in FIG. 2, for example. For instance, the various shapes as described herein.

In embodiments in which the rigid backing has a number of apertures therethrough, the apertures may be curved apertures having a crescent shape or other curved shape. In embodiments in which the rigid backing has a number of apertures therethrough, the apertures can facilitate suction to and/or dust removal from a working surface (e.g., a wall, floor, ceiling, table top, etc.)

In various embodiments, the working material is a fluid permeable (e.g., air permeable) material. In various embodiments, the working material can include a number of apertures therein. In such embodiments, at least some of the apertures in the working material can be in fluid communication with the vacuum cavity (e.g., 165) of the tool via one or more apertures (e.g., 139) in the pad.

In various embodiments, the fluid permeability of the pad and/or working material (e.g., via apertures therethrough) allows for the vacuum force to pass through the working material to the working surface. Such force can, in some embodiments, vacuum dust that is under the working material and/or provide a suction force to the working surface. Such a force can aid in maintaining the tool in position on the working surface and can reduce the amount of dust entering a working area (e.g., a room in which the tool is being used), among other benefits.

In some embodiments, the flow of air to the tool can be reversed such that the air blows onto the working surface rather than being sucked off of the surface. In such embodiments, the vacuum source is actually an air source.

Many vacuum devices provide the ability to switch the direction of air flow in such a manner. As used herein, the term "vacuum source" should be construed to include devices that can blow air onto the working surface.

The shape of the tool support and/or one or more of the various layers (e.g., 105, 106, 107, and 108) of the tool can have any suitable shape (e.g., circular, oval, polygonal, rectangular, square, triangular, or irregular shape). For example, in various embodiments of the present disclosure, the periphery of the tool support has at least five points that are equidistant from the center of the tool support. Such shapes may allow the tool to be more resistant to tipping.

In the embodiment illustrated in FIGS. 1A-1E, the tool support 101 has a circular shape. However, the tool support 101 can, for instance, have a pentagonal, hexagonal, or octagonal shape among various other shapes.

As shown in FIGS. 1A and 1B, the support 101 can have a circular periphery 109 defined by its outside edge. However, embodiments are not limited to a particular peripheral shape.

In various embodiments, at least a portion of a peripheral edge (e.g., 109) of the upper surface of the tool support (e.g., 101) extends beyond the sidewall (e.g., 160), which defines a vacuum cavity (e.g., 165) between the upper and lower surfaces of the tool support, and forms a lip. In the embodiment illustrated in FIGS. 1A-1E, the peripheral edge 109 of the tool support 101 extends beyond sidewall 160 and forms lip 164.

In the embodiments illustrated in FIGS. 1A-1E, a bumper 119 can be attached to the tool support. For example, the bumper 119 can be attached to lip 164.

The bumper 119 can prevent the tool 100 from damaging a surface adjacent to the working surface, among other benefits. For instance, if the working surface to which tool 100 is being applied is a wall surface, then the bumper 119 can prevent the peripheral edge of the tool support 101 from scuffing an adjacent wall surface, ceiling surface, floor surface, or other adjacent surface. A side view of a portion of the tool 100 including the bumper 119 is illustrated in FIG. 1E.

In various embodiments, the bumper 119 is replaceably attached to the tool support 101. In some such embodiments, the bumper can be made of rubber or other resilient material that can be stretched around the periphery (e.g., 109) of the tool support and frictionally held by the lip 164. As described further herein below, in some embodiments, the bumper (e.g., 119) can be removed from the tool support (e.g., 101) and can be replaced with an adapter component that can provide benefits such as increased dust removal from the working surface near the edges of the tool.

As described further in connection with FIGS. 4A and 4B below, in various embodiments, the side wall (e.g., 160) of the tool support (e.g., 101) can include one or more apertures therethrough. In such embodiments, the apertures can facilitate removal of dust from the working surface at or near the periphery of the tool.

Figure 5A:
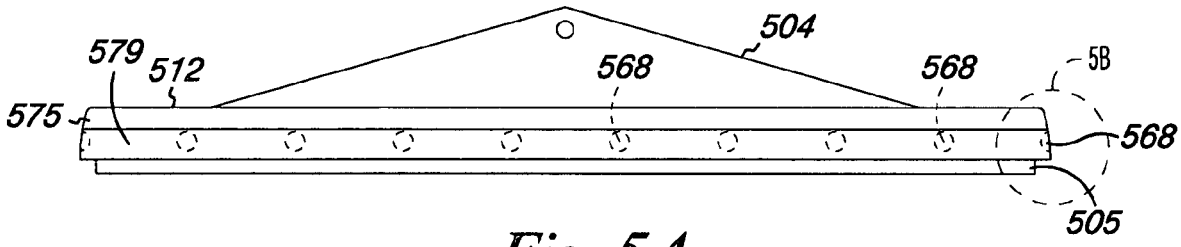
FIG. 5A illustrates a side perspective view of a portion of a tool according to an embodiment of the present disclosure.
Figure 5B:
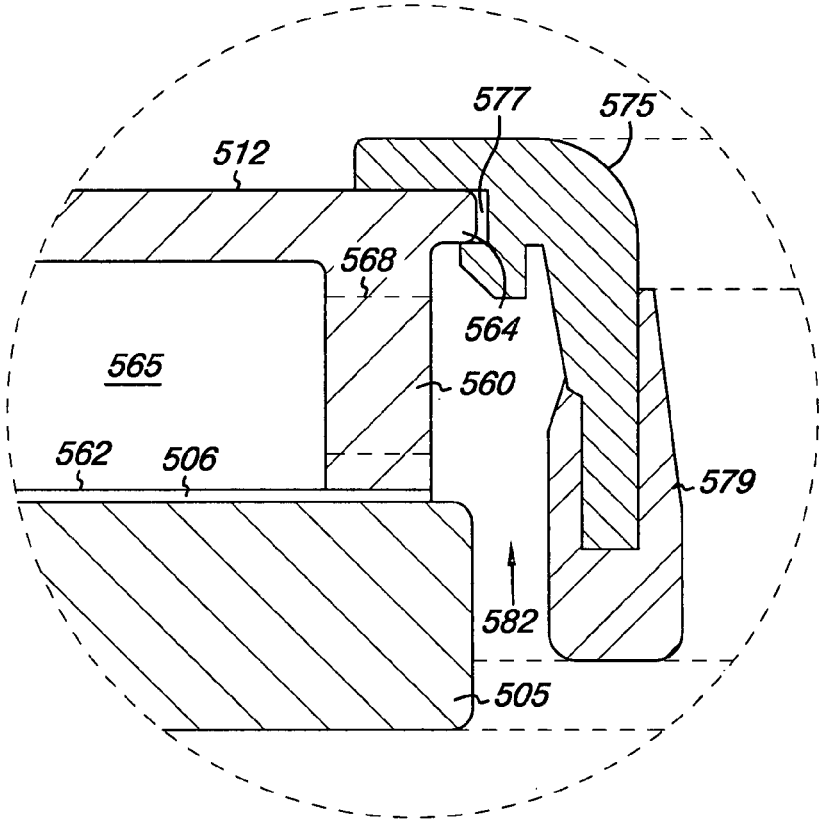
FIG. 5B illustrates a cross-sectional view of a portion of the tool embodiment shown in FIG. 5A indicated by dashed circle 5B.

As described further in connection with FIGS. 5A and 5B, in various embodiments, the tool (e.g., 100) can include an adapter component (e.g., adapter 575 shown in FIGS. 5A and 5B) that can provide a vacuum channel around at least a portion of a periphery of the tool. The vacuum channel can be in fluid communication with the cavity (e.g., 165) via at least one of a number of apertures in the sidewall (e.g., 160).

In one or more embodiments, the vacuum channel provided by the adapter is located between the sidewall and a portion of the adapter component that extends a distance toward a working surface. In such embodiments, the portion of the adapter component can extend generally parallel to the side wall 160 and away from the upper surface of the tool support.

In various embodiments in which the adapter component is used, the adapter component can be attached to the tool support (e.g., 101) in various manners. For instance, the adapter can be attached to the tool support via a notch in the adapter mated with a lipped edge (e.g., 164) of the tool support.

In various embodiments, the adapter component can be releasably attached to the tool support. In such embodiments, the tool 100 can be operated with or without the adapter component.

Figure 2A:
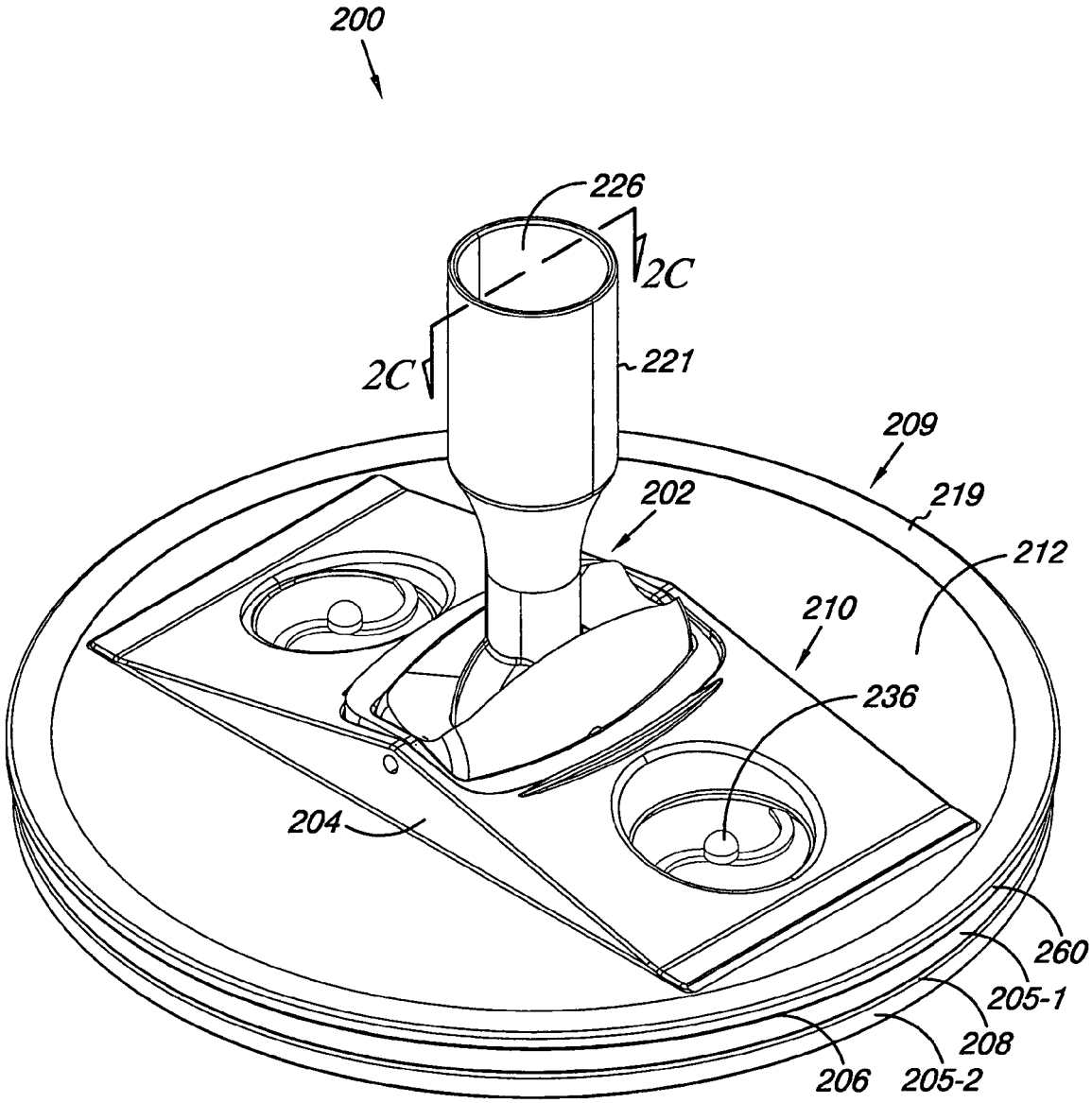
FIG. 2A illustrates a top perspective view of another tool for working on a surface according to an embodiment of the present disclosure.
Figure 2B:
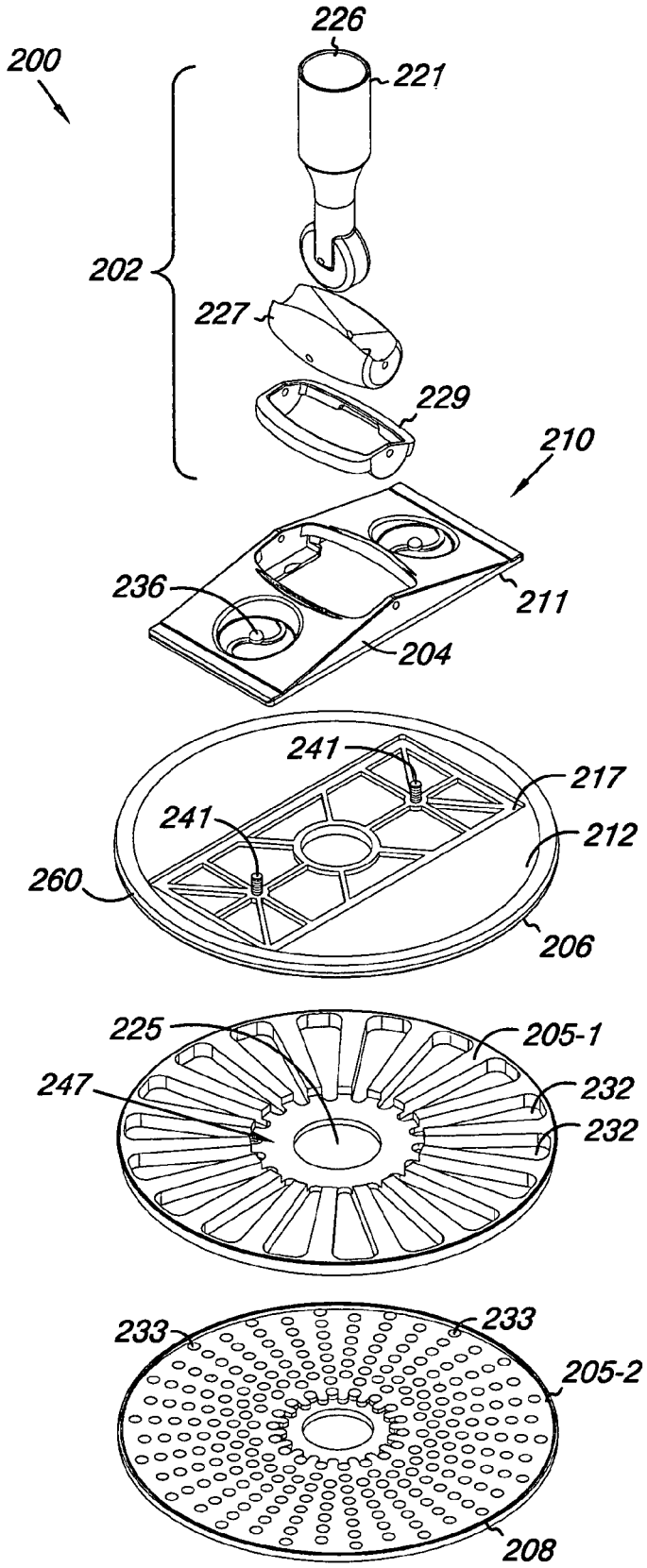
FIG. 2B illustrates an exploded view of the tool embodiment shown in FIG. 2A.
Figure 2C:
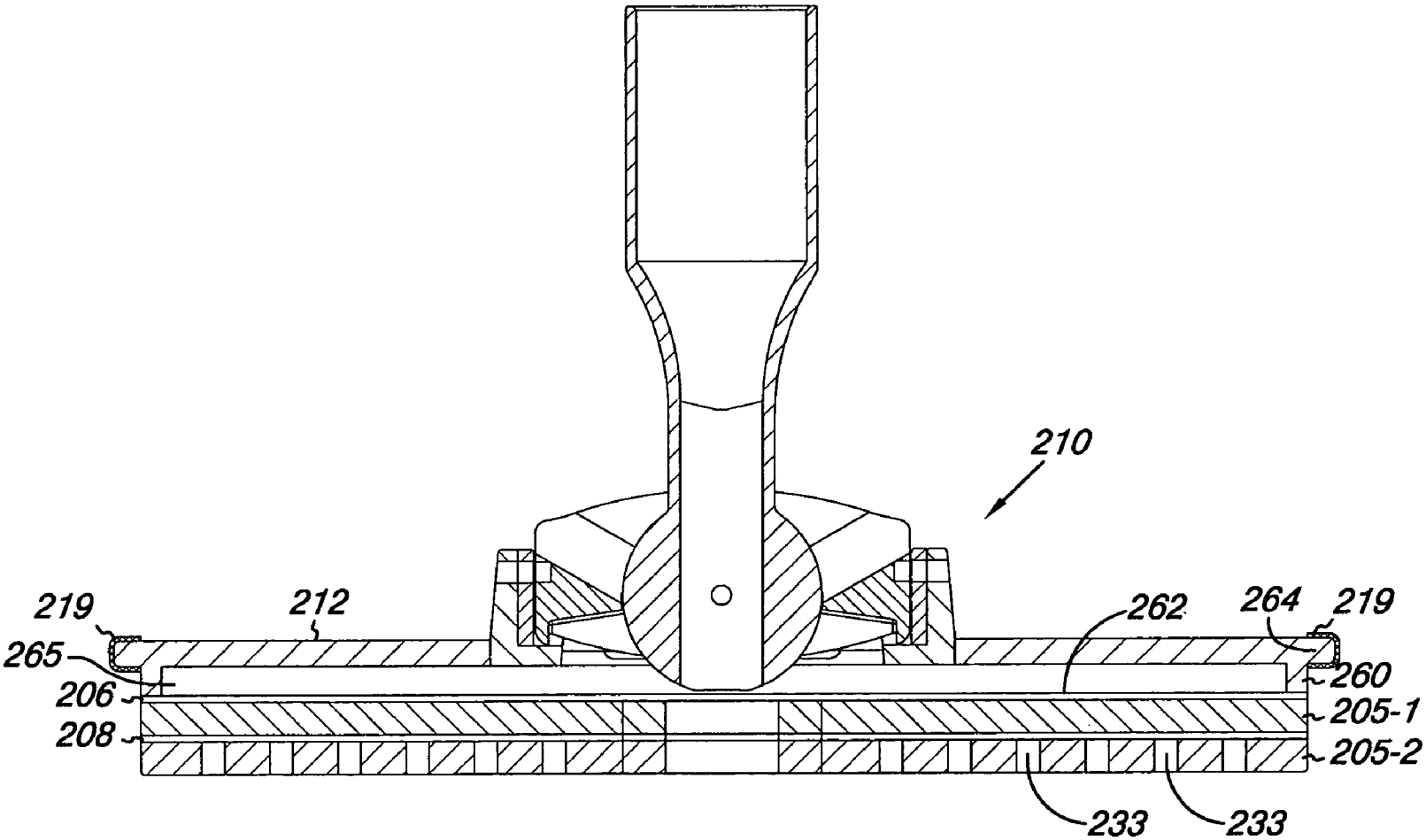
FIG. 2C illustrates a cross sectional view of the tool embodiment shown in FIG. 2A taken along line 2C-2C.
Figure 2D:
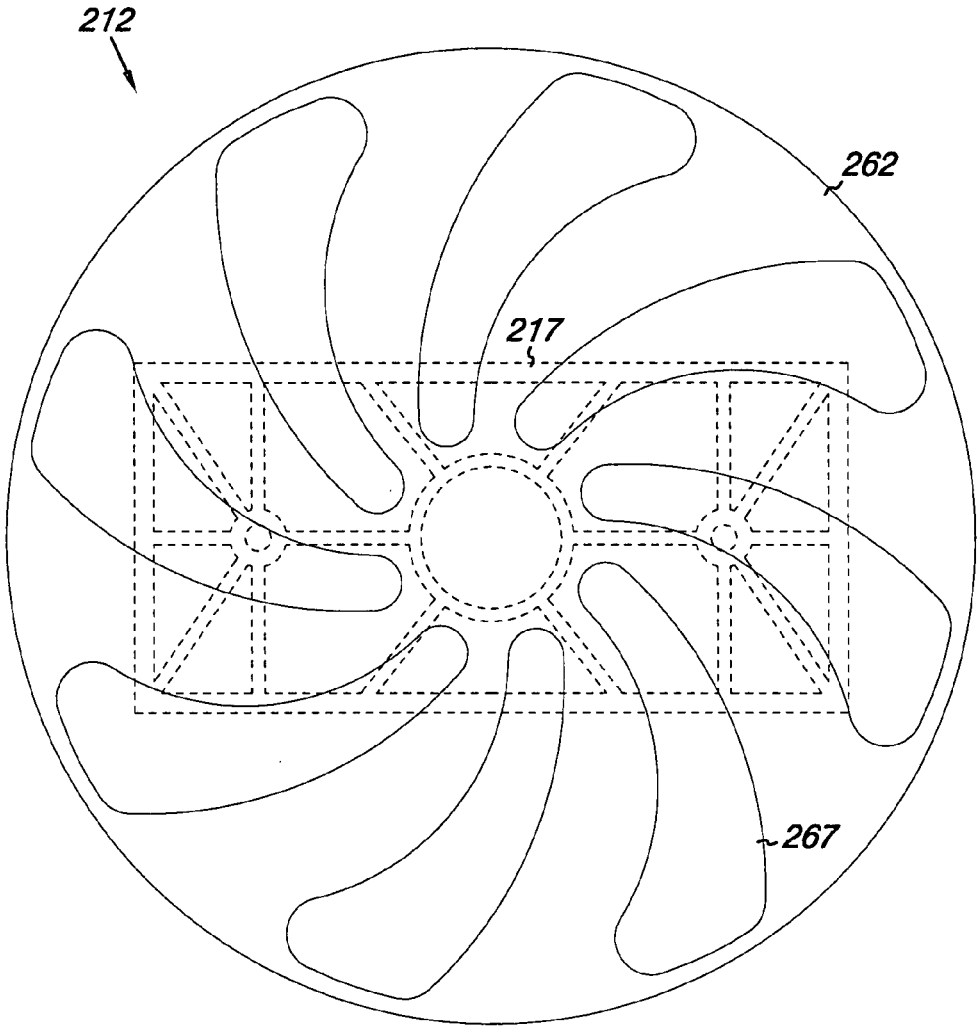
FIG. 2D illustrates a bottom view of a portion of the tool embodiment shown in FIG. 2A.
Figure 2E:
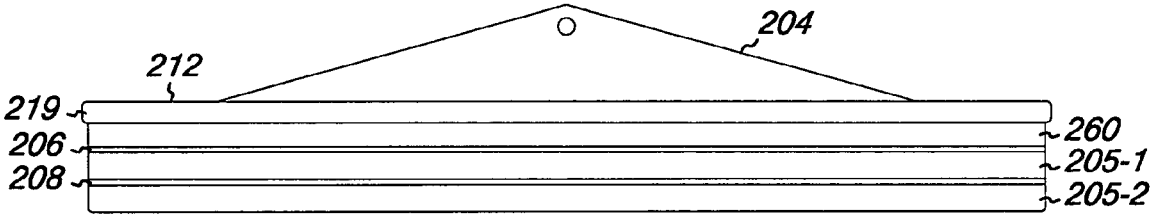
FIG. 2E illustrates a side view of a portion of the tool embodiment shown in FIG. 2A.

FIGS. 2A-2E illustrate a tool 200 for working on a surface according to an embodiment of the present disclosure. FIG. 2A illustrates a top perspective view of the tool 200, FIG. 2B illustrates an exploded view of the tool 200, FIG. 2C illustrates a cross sectional view of the tool 100, FIG. 1D illustrates a bottom view of a portion of the tool 200, and FIG. 2E illustrates a side view of a portion of the tool 200 shown in the embodiment of FIG. 2A.

In the embodiment of FIGS. 2A-2E, the tool head 200 includes a body that is separable into at least two parts. In the embodiment illustrated in FIGS. 2A-2E, the tool head 200 is separable into a first tool support 210 and a second tool support 212.

The first tool support 210 includes a base 204 that is attached to a connector member that can releasably couple to a vacuum source. In the embodiment illustrated in FIGS. 2A-2E, the connector member 221 is a part of a vacuum attachment structure 202.

The attachment structure 202 can be the same as the attachment structure 102 described in connection with FIGS. 1A-1E above. That is, in this embodiment, the attachment structure is a pivoting structure 202 that includes a connector member 221, a socket member 227, and a tilt member 229.

The second tool support 212 is releasably attached to a lower surface of the first tool support 210. In this way, a user can utilize the second tool support 212, for example, for sanding a broad area of a surface, such as a wall. The user can then remove the second tool support 212 and utilize the first tool support 210, for example, to sand the corners or edges of the surface by attaching a working material to the first tool support 210.

If the second tool support 212 is needed again, the second tool support can be reattached to the first tool support 210. Those skilled in the art will understand from reading this disclosure that the first and second tool supports do not need to be directly attached, but rather, can have one or more layers, such as pads and attachment layers, among others, between them as the same have been described herein. In this manner, the embodiment of the tool shown in FIGS. 2A and 2B allows for a first and second tool to be rapidly deployed and can allow for a user to change tools without having to disconnect the vacuum source from the first tool support (e.g., an elongate hollow vacuum pole and/or a hose can remain connected to outlet 226 of vacuum connector member 221 while the tool is changed).

In the embodiment illustrated in FIGS. 2A-2E, the second tool support is releasably attached to the first tool support via a pair of nuts 236 which are threaded onto corresponding bolts 241 projecting out from the second tool support. Embodiments are not limited to a particular attachment mechanism for releasably attaching the first tool support (e.g., 210) to the second tool support (e.g., 212).

For instance, in some embodiments, the first tool support can be releasably attached to the second tool support via a hook and loop fastening structure. That is, the lower surface of the first tool support can include a plurality of hooks that can releasably attach with a plurality of loops on the upper surface of the second tool support, or vice versa. In some embodiments, the attachment mechanism can be push-lock fasteners or quarter turn fasteners that may be spring-loaded, among various other attachment mechanisms suitable for releasably attaching the first tool support to the second tool support.

In the embodiment illustrated in FIGS. 2A-2E, the second tool support 212 includes a recessed portion 217 having a perimeter defined by the perimeter of the first tool support 210 (e.g., the recess 217 is sized to receive the first tool support 210). The recessed portion 217 can provide stability for the tool 200 when the lower surface 211 of the first tool support is within recess 217. For example, the recessed portion 217 can prevent the base 204 of the first tool support 210 from sliding off of the second tool support 212 when the tool 200 is being applied to a working surface.

In various embodiments, and as illustrated in FIGS. 6A and 6B, the first tool support can include a base including a hollow grasping handle (e.g., hollow grasping handle 650 shown in FIGS. 6A and 6B). In such embodiments, the handle can be coupled to a connector member that can be used for releasable attachment to a vacuum source. As described further below in connection with FIGS. 6A and 6B, in embodiments in which the base includes a hollow grasping handle, the connector member (e.g., connector member 602) can be slidable along at least a portion of the length of the handle.

In various embodiments, the connector member 221 is releasably attachable to an elongate hollow handle (not shown). In such embodiments, the pivoting structure 202 can allow a user of tool 200 to reach a large working surface area (e.g., a wall and/or ceiling area) by facilitating movement of the tool in a number of different directions and through a number of different angles by using the elongate handle.

As shown in FIGS. 2A-2E, the second tool support 212 includes a side wall 260 defining a cavity 265 between a lower surface 262 and an upper surface of the second tool support 212. In various embodiments, the lower surface 262 of the second tool support 212 can include a number of apertures therein for facilitating dust removal from the working surface through a vacuum cavity 265 and connector member 221.

One embodiment of the lower surface 262 is illustrated in FIG. 2D. FIG. 2D is a bottom view of the lower surface 262 of the second tool support 212, with the dotted portion representing the recessed portion 217 in the upper surface of tool support 212 (e.g., portion 217 shown in FIG. 2B).

In the embodiment illustrated in FIG. 2D, the lower surface 262 of the second tool support 212 includes a number of apertures 267 therethrough. The apertures can be in any suitable pattern or orientation.

For example, the apertures 267 have a curved (e.g., fan-blade) shape and extend radially outward from the center of the tool support to the periphery of the lower surface of the second tool support. The apertures 267 can have various suitable sizes and shapes. The fan shaped configuration can provide increased flow and/or suction in some embodiments due to the fan pattern of the apertures.

Although the apertures 267 are shown as having a fan-blade shape, embodiments are not so limited. For instance, in some embodiments, the apertures can have varying sizes, shapes, orientations, and/or locations on the surface of the tool support.

In the embodiment illustrated in FIGS. 2A-2E, the second tool support 212 has a circular shape having points on a periphery 209 equidistant from the center of the support 212. This can enable the tool to maintain its stability and reduce the tendency of the tool to flip onto its side.

Additionally, embodiments utilizing a uniformly increased distance of the tool's outside edges from the center of the tool benefit from a reduced ability of the tool to flip (e.g., obviates any proclivity of the tool to upset or flip in a direction of motion). Accordingly, second tool supports having other shapes can provide such benefits and/or others.

In the embodiment illustrated in FIGS. 2A-2E, the second tool support 212 includes an attachment layer 206 that attaches the second tool support 212 to a pad 205-1, and an attachment layer 208 that attaches the pad 205-1 to another layer 205-2. In various embodiments, the layer 205-2 can be another pad layer (e.g., a pad having a resiliency similar or different from pad 205-1).

In such embodiments, the pads 205-1 and 205-2 can be utilized, for example, to cushion the force of the second support 212 to a working material attached to the lower surface of pad 205-2, among other benefits. In some embodiments, the layer 205-2 can be a working material (e.g. a fluid permeable working material).

Those skilled in the art will understand that one type, or several different types of attachment layers can be utilized to attach one or more of the layers (e.g., 205-1 and 205-2) to each other and/or to tool supports 210 and/or 212 of tool 200. For example, those skilled in the art will understand that one or both of the attachment layers 206 and 208 can be used to replaceably attach one or more layers to allow for removal/replacement of one or more of the layers and/or tool supports and attachment of other layers. One or both of the attachment layers 206 and 208 can include an adhesive or a hook and loop fastener structure, among various other attachment mechanisms.

In various embodiments, the pad 205-1 can be replaceably attached to a lower surface of the second tool support. In such embodiments, the pad 205-1 can be replaceably attached to the second tool support via a hook and loop fastening structure (e.g., attachment layer 206 can include corresponding hook and loop surfaces attached to the lower surface of the second tool support and the upper surface of the pad 205-1).

In embodiments in which the layer 205-2 is a working material, the working material can be replaceably attached to a lower surface of the pad 205-1 (e.g., attachment layer 208 can be any suitable attachment mechanism allowing for releasable attachment of layer 205-1 to layer 205-2). In various embodiments, the pad and/or working material can be fluid permeable to allow the passage of dust therethrough.

In embodiments in which layer 205-2 is a pad, the pad 205-2 can be substituted for pad 205-1. That is, pad 205-2 can be attached to the lower surface of the second tool support 212. In such embodiments, a working material layer can be attached to the lower surface of the pad 205-2 (e.g., via any suitable fastening mechanism).

In various embodiments, and as illustrated in FIGS. 2B and 2C, one or more layers attached to a tool support (e.g., tool support 210 and 212) can include one or more apertures therethrough that can be in fluid communication with one or more apertures in the lower surface (e.g., 262) of the tool support. In such embodiments, the configuration of the apertures can provide benefits such as increasing the effective removal of dust from a working surface and/or providing increased suction of the tool to the working surface, among various other benefits. The one or more apertures that can be provided in the various layers (e.g., 205-1 and 205-2) can be of any suitable shape.

In the embodiment illustrated in FIG. 2B, the pad 205-1 includes a plurality of apertures 232 therethrough. In the embodiment of FIG. 2B, the apertures 232 extend radially outward from a central aperture 225 of the pad to less than the periphery of the first pad. Configuration of the apertures in this manner can facilitate suction of the tool to the working surface and/or dust removal when a user forces the tool (e.g., via an elongate pole attached to connector 221) against a working surface, among other benefits.

In the embodiment illustrated in FIG. 2B, the layer 205-2 (e.g., a second pad layer or a working material) includes a plurality of apertures 233 therethrough. In the embodiment of FIG. 2B, the apertures 233 extend radially outward from a central aperture of layer 205-2 to less than the periphery of the layer 205-2. Configuration of the apertures in this manner can facilitate suction of the tool to the working surface and/or dust removal when a user forces the tool (e.g., via an elongate pole attached to connector 221) against a working surface, among other benefits.

As shown in FIG. 2B, the layers 205-1 and 205-2 include a recessed portion (e.g., recessed portion 247). The recessed portion 247 can accommodate a lower end of connection member 221 in embodiments in which the lower portion of the connection member extends below the bottom surface 262 of the second tool support 212 such as described above in connection with FIGS. 1A-1E.

The shape of the tool supports and/or one or more of the other layers of the tool 200 can have any suitable shape. For example, in various embodiments of the present disclosure, the periphery of the first and/or second tool support has at least five points that are equidistant from the center of the tool support. As shown in FIGS. 2A and 2B, the second support 212 has a periphery 209 defined by its outside edge and the periphery 209 has many points that are equidistant from the center of the support 212.

In some embodiments, the tool supports (e.g., 210 and 212) and/or one or more of the various layers (e.g., 205-1, 205-2, 206, and/or 208) of the tool can have a circular, oval, polygonal, or irregular shape. Such shapes may allow the tool to be more resistant to tipping, among other benefits.

In the embodiment illustrated in FIGS. 2A-2E, the periphery of the first tool support 210 has a rectangular shape and the periphery of the second tool support 212 has a circular shape. In such embodiments, the circular shape of the second tool support can be useful for working on an inner area of a working surface such as a wall since the circular shape can reduce the likelihood of the tool flipping on it side. Also, in such embodiments, first tool support can be released from the second tool support to work on edge areas (e.g., areas near corners) of the working surface.

Embodiments are not limited to a particular shape of either the first or the second tool support. For example, one or both of the tool supports 210 and 212 can, for instance, have a pentagonal, hexagonal, triangular, rectangular, or octagonal shape, among various other shapes.

In some embodiments, the first tool support includes a periphery having a triangular shape and the second tool support includes a periphery having a circular shape. In some embodiments both the first tool support and the second tool support can have the same shape. For example, in some embodiments both the first and the second tool support can have a circular shape.

As discussed above and as shown in FIG. 2C, the second tool support 212 includes a side wall 260 defining a cavity 265 defined by the side wall and an upper surface of the second tool support 212. In various embodiments, and as shown in FIG. 2C, the cavity 265 can be further defined by a lower surface 262 of the second tool support 212.

In the embodiment illustrated in FIGS. 2A-2E, the peripheral edge 209 of the second tool support 212 extends beyond sidewall 260 and forms lip 264. As described further in connection with FIGS. 4A and 4B below, in various embodiments, the side wall (e.g., 260) of the second tool support (e.g., 212) can include one or more apertures therethrough. In such embodiments, the apertures can facilitate removal of dust from the working surface at or near the periphery (e.g., 209) of the tool 200, among other benefits.

In the embodiments illustrated in FIGS. 2A-2E, a bumper 219 can be attached to the tool support. As described above in connection with FIGS. 1A-1E, the bumper 219 can be attached to lip 264 and can prevent the tool 200 from damaging a surface adjacent to the working surface, among other benefits.

The bumper 219 can be releasably attached to the second tool support 212. In some embodiments, the bumper (e.g., 219) can be removed from the tool support (e.g., 212) and can be replaced with an adapter component that can provide benefits such as increased dust removal from the working surface near the edges of the tool. A side view of a portion of the tool head 200 including the bumper 219 is illustrated in FIG. 2E.

As noted above and as described further below in connection with FIGS. 5A and 5B, in various embodiments, the tool (e.g., 200) can include an adapter component (e.g., adapter 575 shown in FIGS. 5A and 5B) that can provide a vacuum channel around at least a portion of a periphery of the tool. The vacuum channel can be in fluid communication with the cavity (e.g., 265) via at least one of a number of apertures in the sidewall (e.g., 260).

In one or more embodiments, the vacuum channel provided by the adapter is located between the sidewall and a portion of the adapter component that extends a distance toward a working surface. The portion of the adapter component can extend generally parallel to the side wall 260 and away from the upper surface of the second tool support 212.

Figure 3:
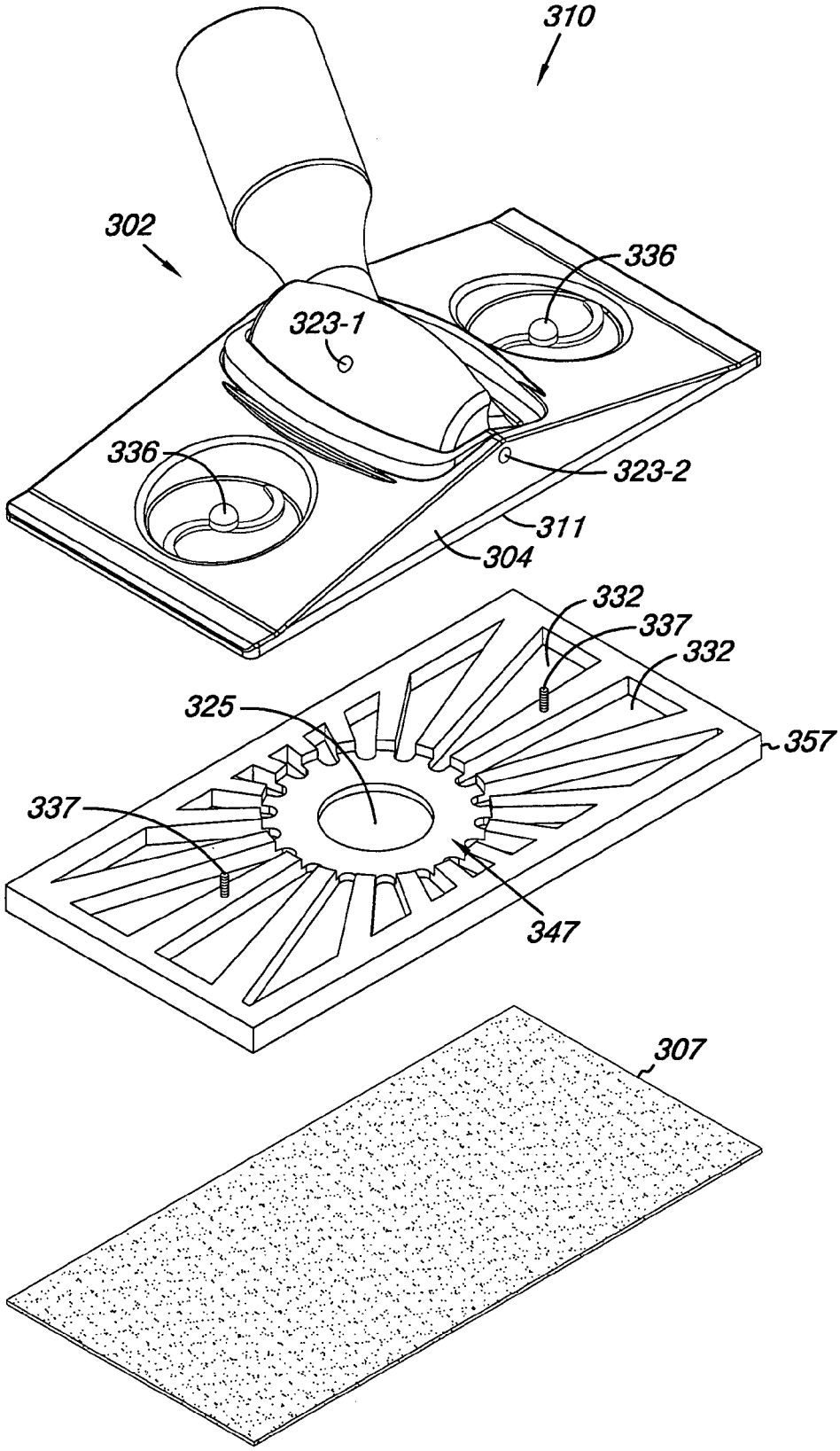
FIG. 3 illustrates a perspective view of another tool for working on a surface according to an embodiment of the present disclosure.

FIG. 3 illustrates a perspective view of another tool for working on a surface according to an embodiment of the present disclosure. In the embodiment illustrated in FIG. 3, the tool support 310 includes a rigid base 304 pivotally coupled to a vacuum attachment structure 302. The rigid base can be made of various metals and/or rigid plastics, among various other rigid materials.

In some embodiments, a tool support similar to tool support 310 can be designed as a single tool rather than being configured to be attached to another tool support. In embodiments, such as that of FIG. 3, the tool support 310 can be releasably attached to another tool support (e.g., as described in the embodiment of FIGS. 2A-2E above, in which first tool support 210 is configured for releasable attachment to second tool support 212).

For example, in the embodiment illustrated in FIG. 3, the tool support 310 includes an attachment mechanism 336 for releasable attachment to another tool support. In such embodiments, the attachment mechanism can be a pair of nuts 336, which can be threaded onto corresponding studs (e.g., bolts such as bolts 241 shown in FIG. 2B) projecting out from the other tool support, among other attachment mechanisms.

As mentioned above, embodiments are not limited to a particular attachment mechanism for releasably attaching the tool support 310 to another tool support. For instance, in some embodiments, the tool support 310 can be releasably attached to the other tool support via a hook and loop fastening structure.

That is, the lower surface 311 of the tool support 310 can include a plurality of hooks that can releasably attach with a plurality of loops on the upper surface of the other tool support, or vice versa. In some embodiments, the attachment mechanism (e.g., 336) can be push-lock fasteners or quarter turn fasteners, among various other attachment mechanisms suitable for releasably attaching the tool support 310 to another tool support.

In the embodiment illustrated in FIG. 3, the attachment structure 302 is the same as attachment structure 102 and 202 described above. That is, the attachment member 302 provides for rotation of the connection member 321 about an axis through a first pivoting point 323-1 and about a second axis, transverse to the first axis, through a second pivoting point 323-2.

In operation, a vacuum source can be connected to the attachment structure and operated to provide suction of the tool to a working surface (e.g., a wall) and/or to remove dust from the working surface via one or more apertures in the tool support.

In various tool embodiments, the tool support 310 can include various numbers of layers attached to a lower surface of the tool support such that the tool support 310 can be used to work on a working surface when the lower surface 311 of tool support 310 is not attached to another tool support. In the embodiment illustrated in FIG. 3, the tool support 310 is detached from another tool support (not shown).

In the embodiment illustrated in FIG. 3, the tool support 310 includes a pad 357 attached to the lower surface 311 of the tool support 310. The pad can be a rigid (i.e., inflexible) or resilient material and, in some embodiments, the pad can be replaceably attached to the tool support. That is, in some embodiments, the pad layer can be attached to the tool support in a releasable manner such that the pad can be replaced (e.g., with a different pad or other layer).

In some embodiments, where the pad is a resilient material, it can be utilized, for example, to cushion the force of the support on the surface being worked on, among other benefits. In various embodiments where the pad is an inflexible material, it can be utilized, for example, to distribute force more directly to the surface being worked on, among other benefits. In various embodiments, the pad can be fluid permeable to allow the passage of dust and/or other particulate therethrough.

The attachment of the various layers to the tool support and/or to each other can be accomplished in any manner. For instance, the pad can be attached to the tool support with an attachment layer.

The attachment layer can include various fastening mechanisms such as hook and loop fasteners, glues, and/or epoxies, among other fastening mechanisms. In the embodiment illustrated in FIG. 3, the pad 357 is replaceably attached to a lower surface 311 of the tool support 310 via wing nuts 336 and bolts 337.

In the embodiment illustrated in FIG. 3, the pad 357 includes a plurality of apertures 332 therethrough. In the embodiment of FIG. 3, the apertures 332 extend radially outward from a central aperture 325 located in a recessed portion 347 of the pad 357.

In various embodiments and as shown in FIG. 3, the apertures 332 extend outward from the aperture 325 to less than the periphery of the first pad as illustrated in the embodiment of FIG. 3. Configuration of the apertures in this manner can facilitate suction of the tool to the working surface and/or can increase vacuum force, thereby increasing dust removal when a user forces the tool against a working surface, among other benefits.

In various embodiments, a working material can be positioned on the tool support itself and, in some embodiments, the working material can be releasably attached to the tool support and/or one or more other layers attached thereto. Such embodiments allow for the working material to be removed and replaced and/or changed to a different kind of working material, among other benefits.

In the embodiment illustrated in FIG. 3, the tool includes a working material 307 replaceably attached to the pad 357. In such embodiments, the working material can then be replaced without changing the pad and the pad can be replaced without having to dispose of the working material, among other benefits. The working material 307 can be fluid permeable and can be replaceably attached to pad 337 via a hook and loop fastening mechanism.

Figure 4A:
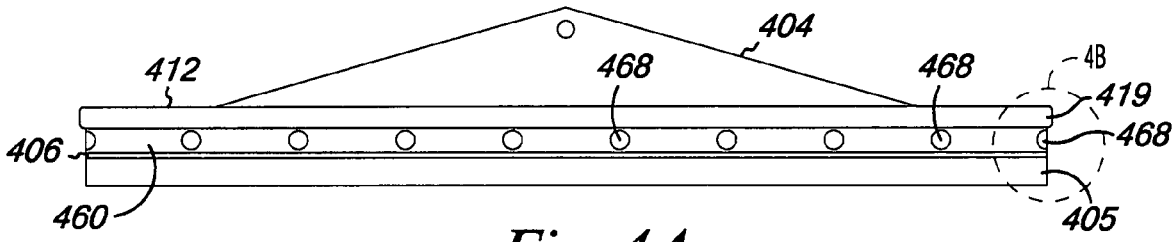
FIG. 4A illustrates a side perspective view of a portion of a tool according to an embodiment of the present disclosure.

FIG. 4A illustrates a side perspective view of a portion of a tool according to an embodiment of the present disclosure. FIG. 4B illustrates a cross-sectional view of a portion of the tool embodiment shown in FIG. 4A indicated by dashed circle 4B.

The side view of the tool shown in FIG. 4A includes a tool support 412. The tool support 412 can be, for example, a tool support similar to tool support 101 described above in connection with FIGS. 1A-1E, a tool support similar to tool support 212 described above in connection with FIGS. 2A-2E, or a tool support similar to tool support 612 described below in connection with FIG. 6A.

Figure 4B:
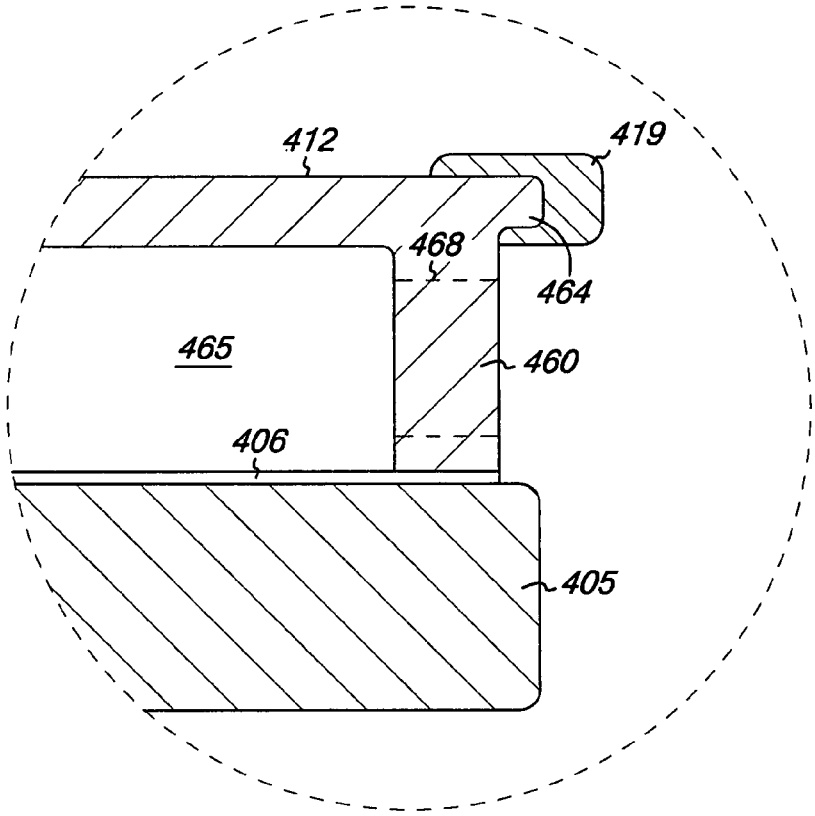
FIG. 4B illustrates a cross-sectional view of a portion of the tool embodiment shown in FIG. 4A indicated by dashed circle 4B.

In the embodiment of FIGS. 4A and 4B, the tool support 412 includes a side surface 460. The side surface can define a cavity (e.g., similar to cavity 165 shown in FIG. 1C or 265 shown in FIG. 2C) defined by the side surface and an upper surface of the tool support 412 as described above. In various embodiments, the cavity (e.g., 465 shown in FIG. 4B) can be further defined by a lower surface of the tool support, the lower surface being attached to the side wall 460. In the embodiment of FIGS. 4A and 4B, the tool includes a pad 405 attached to a lower surface of the tool support 412 via an attachment layer 406. The pad 405 can be fluid permeable and/or can be replaceably attached to the tool support.

In this embodiment, the peripheral edge of the tool support 412 includes a bumper 419. The bumper 419 can be attached to a lip 464 associated with the upper surface of the tool support as described above and shown in FIG. 4B.

The portion of the tool shown in FIG. 4A includes a base 404 attached to the upper surface of the tool support. Although not illustrated in FIG. 4A, the tool can include an attachment structure (e.g., similar to structure 102 described in FIGS. 1A-1E or 202 described in FIGS. 2A-2E) attached to the base 404 for pivotal motion of the tool.

In various embodiments, and as shown in FIGS. 4A and 4B, the side wall 460 of the tool support 412 can include a number of apertures 468 therethrough. The one or more apertures 468 can facilitate removal of dust from the working surface at or near the periphery of the tool.

FIG. 5A illustrates a side perspective view of a portion of a tool according to an embodiment of the present disclosure. FIG. 5B illustrates a cross-sectional view of a portion of the tool embodiment shown in FIG. 5A indicated by dashed circle 5B.

The side view of the tool shown in FIG. 5A includes a tool support 512. The tool support 512 can be, for example, a tool support similar to tool support 101 described above in connection with FIGS. 1A-1E, a tool support similar to tool support 212 described above in connection with FIGS.

2A-2E, or a tool support similar to tool support 612 described below in connection with FIG. 6A.

In the embodiment of FIGS. 5A and 5B, the tool support 512 includes a side surface 560. As shown in FIG. 5B, the side surface 560 can define a cavity 565 defined by the side surface 560 and an upper surface of the tool support 512 as described above. As illustrated in FIGS. 5A and 5B, in some embodiments, the cavity 565 can further be defined by a lower surface 562 of the tool support, the lower surface being attached to the side wall 560.

In this embodiment, the tool includes a pad 505 attached to the lower surface 562 of the tool support 512 via an attachment layer 506. The pad 505 can be fluid permeable and/or can be replaceably attached to the tool support as described herein.

The portion of the tool shown in FIG. 5A includes a base 504 attached to the upper surface of the tool support. Although not illustrated in FIG. 5A, the tool can include an attachment structure (e.g., similar to structure 102 described in FIGS. 1A-1E or 202 described in FIGS. 2A-2E) attached to the base 504 for pivotal motion of the tool.

In the embodiment illustrated in FIGS. 5A and 5B, the side wall 560 of the tool support 512 includes a number of apertures 568 therethrough. The apertures 568 can facilitate removal of dust from the working surface at or near the periphery of the tool, among other benefits.

In the embodiment, illustrated in FIGS. 5A and 5B, the tool includes an adapter component 575 attached to the tool support 512. The adapter component 575 can provide a vacuum channel 582 around at least a portion of the periphery of the tool, among other benefits. As illustrated in FIG. 5B, the vacuum channel 582 is in fluid communication with the cavity 565 via at least one of the apertures 568 in the side wall 560.

In various embodiments, and as illustrated in FIG. 5B, the vacuum channel (e.g., 582) can be located between the side wall (e.g., 560) of the tool support and a portion of the adapter component that extends generally parallel to the side wall and away from the upper surface of the tool support.

In various embodiments, a tool can be used with or without the adapter component. Use of the adapter component (e.g., 575) can provide benefits such as increased dust removal from a working surface as dust can be sucked from the periphery of the tool into the cavity 565 via vacuum channel 582 and one or more apertures 568, among other benefits.

In this embodiment, the adapter 575 is attached to a lip 564 on the peripheral edge of the upper surface of tool support 512. In various embodiments, the adapter component can be releasably attached to the tool support (e.g., 512).

In the embodiment illustrated in FIGS. 5A and 5B, the adapter component 575 is attached to the lip 564, for example, via a notched portion 577. The adapter 575 can be frictionally secured to the tool support 512 or can be attached to the tool support via various attachment mechanisms such as adhesives or other attachment mechanisms.

In various embodiments, and as illustrated in FIGS. 5A and 5B, the adapter member 575 can include a bumper 579. The bumper 579 can be made of a rubber material among various other materials. The bumper 579 can provide benefits such as reducing and/or preventing damage to a surface adjacent to the working surface (e.g., a surface adjacent to the surface to which the tool is being applied), among other benefits.

FIG. 6A illustrates a top perspective view of a tool head 600 separable into a first tool support 610 and a second tool support 612 according to an embodiment of the present disclosure. FIG. 6B illustrates a perspective view of the first tool support 610 shown in FIG. 6A.

In the embodiment illustrated in FIG. 6A the first tool support 610 is releasably attached to the second tool support 612. The first tool support can be releasably attached to the second tool support via various attachment mechanisms as has been described herein. In the embodiment of FIG. 6A, the lower surface of base 604 of the first tool support 610 can be releasably attached to an upper surface of the second tool support 612, for example, via a hook and loop fastening structure, or other suitable fastening mechanism.

In the embodiment of FIGS. 6A and 6B, the first tool support includes a hollow grasping handle 650 having a first end 651-1 and a second end 651-2. In various embodiments, at least one of the first end 651-1 and second end 651-2 are in fluid communication with an aperture in the first tool support 610. In the embodiment illustrated in FIGS. 6A and 6B, both ends 651-1 and 651-2 of the grasping handle 650 are in fluid communication with an aperture in the first tool support 610.

In various embodiments, and as shown in FIGS. 6A and 6B, the first tool support can include an attachment member 602 coupled to the hollow grasping handle for releasable attachment to a vacuum source (e.g., a vacuum hose of a shop vacuum). The attachment member 602 includes an outlet 626 which provides fluid communication between a vacuum source attached to the attachment member 602 and the interior of hollow handle 650 in order to facilitate suction to a working surface and/or dust removal from a working surface.

In the embodiment illustrated in FIGS. 6A and 6B, the attachment member 602 is slidable along at least a portion of a length of the grasping handle 650 (e.g., within slot 652). The slidable nature of the attachment member 602 can provide a user of tool support 610 with a comfortable grip when the user grasps the handle at either the first end 651-1, the second end 651-2, or both ends.

As previously described herein, the first and second tool supports can have various sizes and/or shapes. In the embodiment illustrated in FIGS. 6A and 6B, the first tool support 610 has a periphery (e.g., the periphery of the base 604) having a rectangular shape, while the periphery of the second tool support 612 has a circular shape.

Also, in the embodiment illustrated in FIGS. 6A and 6B, the periphery of the first tool support 610 is smaller than the periphery of the second tool support. In such embodiments, the circularly shaped second tool support having a larger periphery can be useful for working on large inner areas of working surfaces (e.g., inner portions of walls), while the rectangularly shaped first tool support can be released from the second tool support (e.g., as shown in FIG. 6B) for working on and/or near edges of working surfaces.

In various embodiments, the second tool support can include a recess in the upper surface that receives a finger of a hand when a user's hand is placed through the arch in the grasping handle.

In the embodiment illustrated in FIG. 6A, the upper surface of the second tool support 612 includes a number of recesses 655 that can receive one or more fingers of a user of tool 600.

The recesses 655 can provide various benefits. For example, the recesses 655 can provide comfort to a user of the tool and can reduce and/or prevent a user's fingers from sliding off of the upper surface of tool support 612 while manipulating the tool with the user's hand. In the embodiment of FIG. 6A, recesses 655 are placed on either side of the arch of the handle 650 such that a user of the tool can insert a hand through the arch from either side. Embodiments can include recesses on one or both sides, more or less recesses than the eight shown in FIG. 6A, and/or the recesses can include various other shapes.

In the embodiment illustrated in FIG. 6A, the tool 600 includes a pad 605 attached to the second tool support 612 and a working material 607 attached to the pad 605. The pad can be replaceably attached to the lower surface of the second tool support via an attachment layer 606 and the working material can be replaceably attached to the pad via an attachment layer 608 in various manners such as those described above (e.g., hook and loop fasteners, epoxies, or glues, among other attachment mechanisms).

In the embodiment illustrated in FIG. 6A, the second tool support 612 includes a sidewall 660. The sidewall can be attached to an upper surface of the tool support 612 and can define a cavity (e.g., similar to cavity 165 discussed in the embodiment of FIGS. 1A-1E).

In the embodiment illustrated in FIG. 6A, the second tool support 612 includes a bumper 619 attached to a peripheral edge of the tool support 612. The bumper 619 can be a bumper similar to bumper 419 described in connection with the embodiment of FIGS. 4A and 4B above.

In various embodiments, and as shown in the embodiment of FIG. 6B, the tool 600 can include a pad 657 attached (e.g., replaceably) to the first tool support 610 for working on a surface when the first tool support is not attached to the second tool support 612. The pad 657 can be attached to the lower surface 611 of the tool support 610 via a hook and loop fastening structure or other suitable fastening mechanism allowing for replacing the pad 657 (e.g., with another pad).

In various embodiments, the pad 657 can include a number of apertures therethrough. The apertures can facilitate dust removal from a working surface.

In the embodiment illustrated in FIG. 6B, the pad 657 includes two apertures 625. In the embodiment of FIG. 6B, each aperture 625 corresponds to an aperture through base 604 at the first end 651-1 and second end 651-2 of the hollow grasping handle 650. However, the embodiments should not be so limited.

In the embodiment illustrated in FIG. 6B, the pad 657 includes a plurality of apertures 632 extending radially outward from each of apertures 625. In the embodiment shown in FIG. 6B, the apertures 632 extend to less than the periphery of the pad 657; however, embodiments are not so limited. Some embodiments may not include apertures.

In various embodiments, the tool 600 can also include a working material attached to the lower surface of the pad 657 for working on a surface when the first tool support 610 is not attached to the second tool support 612. In such embodiments, the working material can be formed on the lower surface of the pad or can be replaceably attached to the lower surface of the pad via an attachment layer (e.g., a hook and loop fastening structure). In various embodiments, the pad 657 and/or the working material can be a fluid permeable material.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the invention.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A tool for working on a surface, comprising:
a tool support including:
an upper surface; and
a cavity defined by a sidewall and the upper surface; and
a vacuum attachment structure attached to a base portion of the tool support, the attachment structure including:
a connector member having an opening in a first end for releasable attachment to a vacuum source; and
a socket member that receives a lower portion of the connector member and is connected to the connector member to provide rotation of the connector member about a first axis,
wherein an opening in a second end of the connector member is located below the upper surface of the tool support and provides fluid communication between the cavity and the opening at the first end of the connector member; and
wherein the socket member is connected to the base portion to provide rotation of the connector member about a second axis.

2. The tool of claim 1, where the sidewall includes a number of apertures therethrough.

3. The tool of claim 2, where the tool includes an adapter component for providing a vacuum channel around at least a portion of a periphery of the tool, the vacuum channel in fluid communication with the cavity via at least one of the number of apertures in the sidewall.

4. The tool of claim 3, where the vacuum channel provided by the adapter component is located between the sidewall and a portion of the adapter component that extends generally parallel to the side wall and away from the upper surface.

5. The tool of claim 4, where at least a portion of a peripheral edge of the upper surface extends beyond the sidewall and forms a lip to which the adapter component is attached.

6. The tool of claim 5, where the adapter component is releasably attached to the tool support.

7. The tool of claim 1, where the tool support includes a pad replaceably attached to a lower surface of the tool support and a working material replaceably attached to a lower surface of the pad.

8. The tool of claim 1, where the tool support has a periphery with at least five points equidistant from a center of the tool support.

9. A tool for working on a surface, comprising:
a tool support including an attachment structure attached to the tool support, the attachment structure including:
a connector member having an opening in a first end for releasable attachment to a handle or vacuum source;
a socket member that receives a lower portion of the connector member and is pivotally connected to the connector member to provide for rotation of the connector member about a first axis; and a tilt plate that receives the socket member and is pivotally connected to the socket member and to the tool support to provide for rotation of the connector member and the socket member about a second axis.

10. The tool of claim 9, where the tool support includes:

an upper surface; and a sidewall that defines a cavity between the sidewall and the upper surface; and where an opening in a second end of the connector member is located below the upper surface of the tool support and provides fluid communication between the cavity and the opening at the first end of the connector member.

11. The tool of claim 10, where a lower surface of the tool support is connected to the sidewall and further defines the cavity, the lower surface having a number of apertures therein providing fluid communication between the cavity and a number of apertures in a pad replaceably attached to the lower surface of the tool support.

12. The tool of claim 10, where the lower surface of the tool support having the number of apertures therein provides fluid communication between the cavity and a number of apertures in a working material replaceably attached to a lower surface of a pad.

13. A tool for working on a surface, comprising:

a tool support including an attachment structure attached to the tool support, the attachment structure including:

a connector member having an opening in a first end for releasable attachment to a handle or vacuum source;

a socket member that receives a lower portion of the connector member, is pivotally connected to the connector member to provide for rotation of the connector member about a first axis, and is pivotally connected to the tool support to provide for rotation of the connector member about a second axis; and a tilt plate that receives the socket member and is pivotally connected to the socket member and to the tool support, the tilt plate being rotatable about the second axis to provide further rotation of the connector member about the second axis.

* * * * *